US009062426B2

(12) United States Patent
Ito et al.

(10) Patent No.: US 9,062,426 B2
(45) Date of Patent: Jun. 23, 2015

(54) WORK VEHICLE

(75) Inventors: Shinji Ito, Wako (JP); Tatsuo Masuda, Wako (JP); Yasuji Hashimoto, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 152 days.

(21) Appl. No.: 13/884,745

(22) PCT Filed: Dec. 22, 2010

(86) PCT No.: PCT/JP2010/007440

§ 371 (c)(1),
(2), (4) Date: May 10, 2013

(87) PCT Pub. No.: WO2012/085972

PCT Pub. Date: Jun. 28, 2012

(65) Prior Publication Data

US 2013/0220896 A1 Aug. 29, 2013

(51) Int. Cl.
*E01H 12/00* (2006.01)

(52) U.S. Cl.
CPC ..... *E01H 12/00* (2013.01)

(58) Field of Classification Search
CPC ..... A01D 17/10; A01D 51/00; A01D 90/12; A01D 2017/105; E01H 12/00; E01H 12/002
USPC ..... 56/328.1; 171/63, 124, 116, 98, 92, 12, 171/111, 65; 198/509; 210/776, 923
See application file for complete search history.

(56) References Cited

U.S. PATENT DOCUMENTS

| | | | | | |
|---|---|---|---|---|---|
| 4,014,390 | A | * | 3/1977 | Teixeira | 171/124 |
| 4,241,792 | A | * | 12/1980 | Kratzer | 171/63 |
| 4,282,932 | A | * | 8/1981 | Anderson | 171/63 |
| 4,542,550 | A | * | 9/1985 | Bennett et al. | 15/3 |
| 5,480,098 | A | * | 1/1996 | Doppstadt | 241/101.76 |
| 2014/0346092 | A1 | * | 11/2014 | Kimura et al. | 209/235 |

FOREIGN PATENT DOCUMENTS

| | | | |
|---|---|---|---|
| JP | 2-208154 | A | 8/1990 |
| JP | 6-156215 | A | 6/1994 |
| JP | 2002-225794 | A | 8/2002 |
| JP | 2006-29418 | A | 2/2006 |
| JP | 2010-174518 | A | 8/2010 |

* cited by examiner

*Primary Examiner* — Robert Pezzuto
(74) *Attorney, Agent, or Firm* — Birch, Stewart, Kolasch & Birch, LLP

(57) ABSTRACT

There is provided a work vehicle having a wheel lock mechanism that is compactly disposed while avoiding an effect of surrounding sand. A wheel lock mechanism 201 has a disc portion 202 rotating integrally with a wheel 53 inside a rim portion 56A of the wheel 53, and a slide member 20X that is movable in the axial direction of the wheel 52 so as to be freely engageable with the disc portion 202 inside the rim portion 56A and rotates integrally with the axle 52.

20 Claims, 16 Drawing Sheets

(A)

(B)

(C)

(D)

WORK VEHICLE

TECHNICAL FIELD

The present invention relates to a work vehicle having a rotating unit that is rotated by rotational force of an axle.

BACKGROUND ART

There is known a garbage separation and recovery machine for beach clean that recovers garbage from sandy ground while towed by a vehicle (also referred to as "beach cleaner") (see Patent Document 1, for example). In this Patent Document 1, a sieving unit for separating sand and garbage from each other is provided, and the sieving unit is rotationally driven by using the rotational force of an axle.

Furthermore, some special work vehicles such as a tractor, etc. have a wheel lock mechanism for locking/unlocking right and left wheels to/from an axle (see Patent Document 2, for example).

PRIOR ART DOCUMENT

Patent Document

Patent Document 1: JP-A-2010-174518
Patent Document 2: JP-A-2006-29418

SUMMARY OF THE INVENTION

Problem to be Solved by the Invention

In the Patent Document 1, the sieving unit is rotated by one wheel. With respect to this construction, when a large amount of garbage or sand exists in the sieving unit, the weight of the garbage may obstruct rotation of the wheel. In order to avoid this problem, it may be considered to provide a wheel lock mechanism so that the right and left wheels are locked to the axle and rotate the sieving unit by the right and left wheels. Here, when a vehicle goes round a curve on a road surface having high frictional force such as a paved road or the like, the difference in rotation between the right and left wheels is absorbed by releasing the wheel lock mechanism so as to make the vehicle easily go round the curve.

However, a conventional wheel lock mechanism is disposed in the case of a differential, and the device itself is heavy and large in size. Therefore, it is unsuitable for use in a garbage separation and recovery machine for beach cleaning which has no differential and is required to be designed in a simple construction.

Furthermore, the garbage separation and recovery machine for beach cleaning is a work vehicle running on the sand, and it is required to be constructed and arranged so as not to be affected by sand or the like because sand also drops from the sieving unit. However, the conventional wheel lock mechanism cannot be compactly laid out with satisfying the above requirement.

The present invention has been implemented in view of the foregoing situation, and has an object to provide a work vehicle having a wheel lock mechanism which is compactly arranged while avoiding from being affected by surrounding sand.

Means of Solving the Problem

In order to solve the above problem, according to the present invention, a work vehicle having a vehicle body frame (51) towed by a vehicle, right and left wheels (53) secured to an axle (52) which is freely rotatably supported by the vehicle body frame (51), and a rotating unit (54) which is rotated by rotational force of the axle (52), further comprises a wheel lock mechanism (201) that locks and unlocks a wheel (53) to and from the axle (52), wherein the wheel lock mechanism (201) has a disc member (202) that rotates integrally with the wheel (53) inside a rim portion (56A) of the wheel (53), and a slide member (20X) that is movable in an axial direction of the axle (52) so as to be engageable with the disc member (202) inside the rim portion (56A) and rotates integrally with the axle (52).

According to this construction, the wheel lock mechanism has the disc member rotating integrally with the wheel inside the rim portion of the wheel, and the slide member that moves in the axial direction so as to be freely engageable with the disc member inside the rim portion and rotates integrally with the axle. Therefore, the wheel lock mechanism can be compactly disposed by using the dead space inside the rim portion provided to the work vehicle, and the effect of surrounding sand on the wheel lock mechanism can be avoided.

In the above construction, the disc member (202) may have a hole portion (202A) penetrating therethrough in the axial direction of the axle (52) and a non-penetration portion (202B) that non-penetrates therethrough, the slide member (20X) may have a lock pin (204) that moves in the axial direction so as to be capable of entering the hole portion (202A), and there may be provided an urging member (207) that urges the lock pin (204) to the disc member (202) so that the lock pin is brought into contact with the non-penetration portion (202B) until the lock pin (204) and the hole portion (202A) are matched with each other in phase, and makes the lock pin enter the hole portion (202A) when the lock pin (204) and the hole portion (202A) are matched with each other in phase through the rotation of the wheel (53). According to this construction, when the lock pin and the hole portion of the disc member are matched with each other in phase, the axle and the wheel can be automatically locked to each other, and the switching to the lock state can be easily performed.

In the above construction, the slide member (20X) may have a slider (203) that supports the lock pin (204) so that the lock pin (204) is freely movable in the axial direction of the axle (52), and the slider (203) may be movable to a lock position at which the lock pin (204) is made to enter the hole portion (202A) and an unlock position at which the lock pin (204) is located out of the hole portion (202A). According to this construction, the lock and the unlock can be easily switched to each other by moving the slider.

In the above construction, the work vehicle may further comprise an urging member for return (206) that urges the slider (203) to the unlock position, and a snap ring (205) that is freely rotatably provided to the axle (52) and moves the slider (203) to the lock position against urging force of the urging member for return (206) by rotation thereof. According to this construction, the switching to the unlock state can be easily performed by the urging force of the urging member for return, and the snap ring can be actuated by a simple operation such as a rotating operation.

In the above construction, the disc member (202) and the lock pin (204) may be engaged with each other within a width of the rim portion (56A), and the snap ring (205) may be exposed to an outside of the width of the rim portion (56A). According to this construction, the operating performance of the snap ring can be enhanced while the effect of sand on the engagement portion is effectively avoided.

Furthermore, in the above construction, the urging member (207) may comprise a coil spring through which the lock pin (204) is inserted, and the urging member for return (206) may comprise a coil spring through which the axle (52) is inserted. According to this construction, the respective urging members can be disposed by using the narrow space around the lock pin and the axle, and the wheel lock mechanism can be made compact in the radial direction.

In the above construction, the disc member (202) may be provided to a hub portion (57) of the wheel (52), a fastening portion (58) that fastens the hub portion (57) to a wheel body (56) of the wheel (52) may be provided, and the fastening portion (58) and the hole portion (202A) of the disc member (202) may be provided to be in phase with each other. According to this construction, the work of inserting a tool from the hole portion of the disc member and fastening the hub portion to the wheel body can be easily performed.

In the above construction, the rotating unit (54) may be a drum type sieving unit that is freely rotatably secured to the vehicle body frame (51) above the axle (52), and the work vehicle may be a garbage separation and recovery machine that has a driving gear (92) secured to the axle (52) and a transmission mechanism (91) that transmits driving force of the driving gear (92) to the drum type sieving unit (54). According to this construction, the drum type sieving body is disposed above the axle, and thus sand dropping out of the drum type sieving body can be prevented from affecting the wheel lock mechanism.

Furthermore, in the above construction, the transmission mechanism (91) may have switching means (95) that switches an automatic rotation mode in which the drum type sieving unit (54) is rotated by rotational force of the axle (52) and a manual rotation mode in which the drum type sieving unit (54) is released from the rotational force of the axle (52) and made to be manually freely rotatable. According to this construction, the drum type sieving body can be rotated by the towing force of the towing vehicle to perform the garbage separation work, and also the drum type sieving body can be easily manually rotated by human power to perform the garbage separation work. The handling performance is high, and the garbage separation work can be performed in accordance with various conditions.

Effect of the Invention

According to the present invention, the wheel lock mechanism has the disc member rotating integrally with the wheel inside the rim portion of the wheel, and the slide member that moves in the axial direction of the axle so as to be freely engageable with the disc member inside the rim portion and rotates integrally with the axle. Therefore, the wheel lock mechanism can be compactly disposed without being affected by surrounding sand.

The disc member has the hole portion penetrating in the axial direction of the axle and the non-penetration portion which does not penetrate, the slider member has the lock pin which moves in the axial direction so as to be insertable into the hole portion, and there is provided the urging member that urges the lock pin to the disc member to bring the lock pin into contact with the non-penetration until the lock pin and the hole portion are coincident with each other in phase, and makes the lock pin enter the hole portion when the lock pin and the hole portion are in phase with each other through the rotation of the wheel. Therefore, the switching to the lock state can be easily performed.

The slider member has the slider that supports the lock pin so that the lock pin is freely movable in the axial direction of the axle, and the slider is made movable to the lock position at which the lock pin enters the hole portion and the unlock position at which the lock pin is located out of the hole portion. Accordingly, the lock and the unlock can be easily switched to each other by moving the slider.

Furthermore, there are provided the urging member for return that urges the slider to the unlock position, and the snap ring that is freely rotatably provided to the axle and moves the slider to the lock position against the urging force of the urging member for return by the rotation thereof. Accordingly, the switching to the unlock state can be easily performed by the urging force of the urging member for return, and the snap ring can be actuated by a simple operation such as a rotating operation.

Furthermore, the disc member and the lock pin are engaged with each other within the width of the rim portion, and the snap ring is exposed to the outside of the width of the rim portion. Accordingly, the operation performance of the snap ring can be enhanced while the engagement portion is effectively avoided from being affected by sand.

Still furthermore, the urging member is the coil spring through which the lock pin is inserted, and the urging member for return is the coil spring through which the axle is inserted. Accordingly, the respective urging members can be disposed by using the narrow space surrounding the lock pin and the axle and also the wheel lock mechanism can be compactly disposed in the radial direction.

The disc member is provided to the hub portion of the wheel, the fastening portion for fastening the hub portion to the wheel body of the wheel is provided, and the fastening portion and the hole portion of the disc member are provided to be in phase with each other. Accordingly, the work of inserting a tool from the hole portion of the disc member and fastening the hub portion to the wheel body can be easily performed.

The rotating unit is the drum type sieving body which is freely rotatably secured to the vehicle body frame above the axle, and the work vehicle is the garbage separation and recovery machine having the driving gear secured to the axle and the transmission mechanism for transmitting the driving force of the driving gear to the drum type sieving body. Accordingly, the drum type sieving body is disposed above the axle, and the wheel lock mechanism can be prevented from being affected by the sand dropping from the drum type sieving body.

Furthermore, the transmission mechanism has the switching means for switching the automatic rotation mode in which the drum type sieving body is rotated by the rotational force of the axle and the manual rotation mode in which the drum type sieving body is released from the rotational force of the axle and made to be freely manually rotatable. Accordingly, the handling performance is enhanced, and the garbage separation work can be performed in accordance with various conditions.

BRIEF DESCRIPTION OF THE DRAWINGS

FIG. 16(A) is viewed in a Y direction, FIG. 16(A) is viewed in a Z direction.

BEST MODES FOR CARRYING OUT THE INVENTION

An embodiment according to the present invention will be described with reference to the drawings. In the description, the front-and-rear, right-and-left and up-and-down directions are the same as those defined for a vehicle body if otherwise described.

Figure 1:
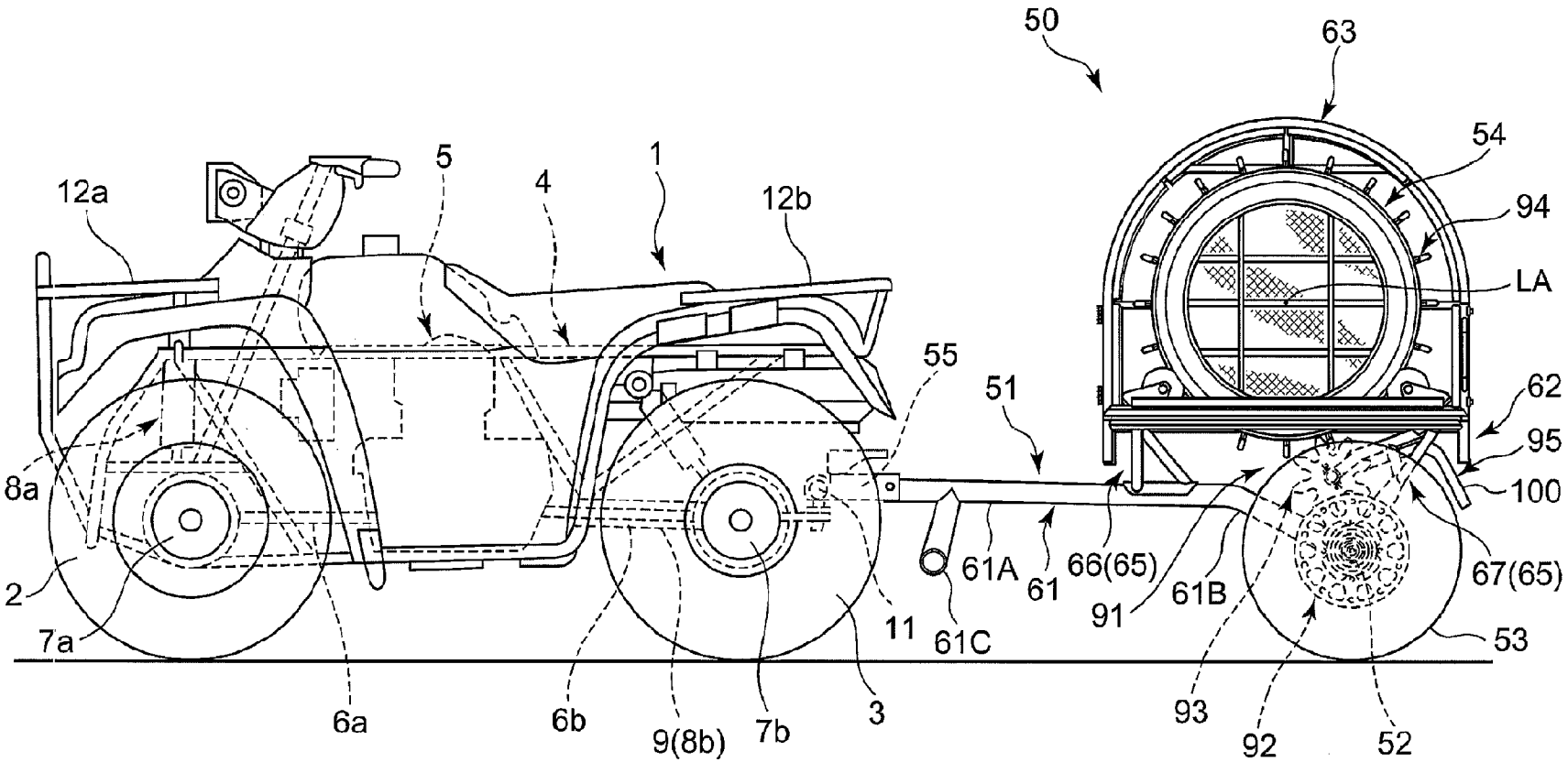
FIG. 1 is a left side view showing a towing state of a garbage separation and recovery machine for beach cleaning according to an embodiment.

FIG. 1 is a left side view of a towing state of a beach cleaning garbage separation and recovery machine according to an embodiment.

As shown in FIG. 1, the beach cleaning garbage separation and recovery machine (hereinafter referred to as garbage separation and recovery machine) 50 is constructed as a towing type work vehicle which can be towed by a vehicle 1.

The vehicle (towing vehicle) 1 is a compact vehicle suitable for running on sandy ground such as a beach or the like, and configured as a so-called ATV (All Terrain Vehicle) in which right and left front wheels 2 and right and left rear wheels 3 as low-pressure balloon tires having a relatively large diameter are provided at the front and rear sides of the vehicle body configured in small size and light weight and the minimum ground clearance is set to be large so that the running performance is enhanced mainly on uneven ground. The vehicle body frame 4 of the vehicle 1 is designed in a box-like structure so as to be long in the front-and-rear direction at the center portion in the vehicle width direction, and an engine 5 as a motor for the vehicle 1 is mounted substantially at the center portion of the vehicle body frame 4.

The engine 5 is a water cooling type single cylinder engine, for example, and outputs the rotational driving force of a crankshaft to front and rear propeller shafts 6*a*, 6*b* through a gear engagement type transmission. The rotational driving force output to the front and rear propeller shafts 6*a*, 6*b* is output to right and left front wheels 2 or right and left rear wheels 3 through front and rear reduction gears 7*a*, 7*b*.

Here, the vehicle 1 is a so-called semi-automatic vehicle in which the gear ratio of the transmission can be changed by electric operation. For example, the gear ratio can be changed through a centrifugal clutch by only operating a change button or the like without performing a clutch operation. The vehicle 1 as described above is also suitable for running under a large running load or running at a constant speed as compared with a vehicle having a belt type transmission.

The vehicle 1 is not limited to the semi-automatic vehicle, but it may be an automatic transmission vehicle in which the gear ratio can be automatically changed, for example.

The right and left front wheels 2 are suspended from the front portion of the vehicle body frame 4 through an independent suspension type front suspension 8*a*, and the right and left rear wheels 3 are suspended from the rear portion of the vehicle body frame 4 through a swing arm type rear suspension 8*b*, for example. A trailer hitch 11 for towing a garbage separation and recovery machine 50, etc. is provided to the rear end portion of the swing arm 9 of the rear suspension 8*b*.

In FIG. 1, reference numeral 12*a* represents a front carrier supported at the front portion of the vehicle body frame 4, and reference numeral 12*b* represents a rear carrier supported at the rear portion of the vehicle body frame 4.

Next, the garbage separation and recovery machine 50 will be described.

Figure 2:
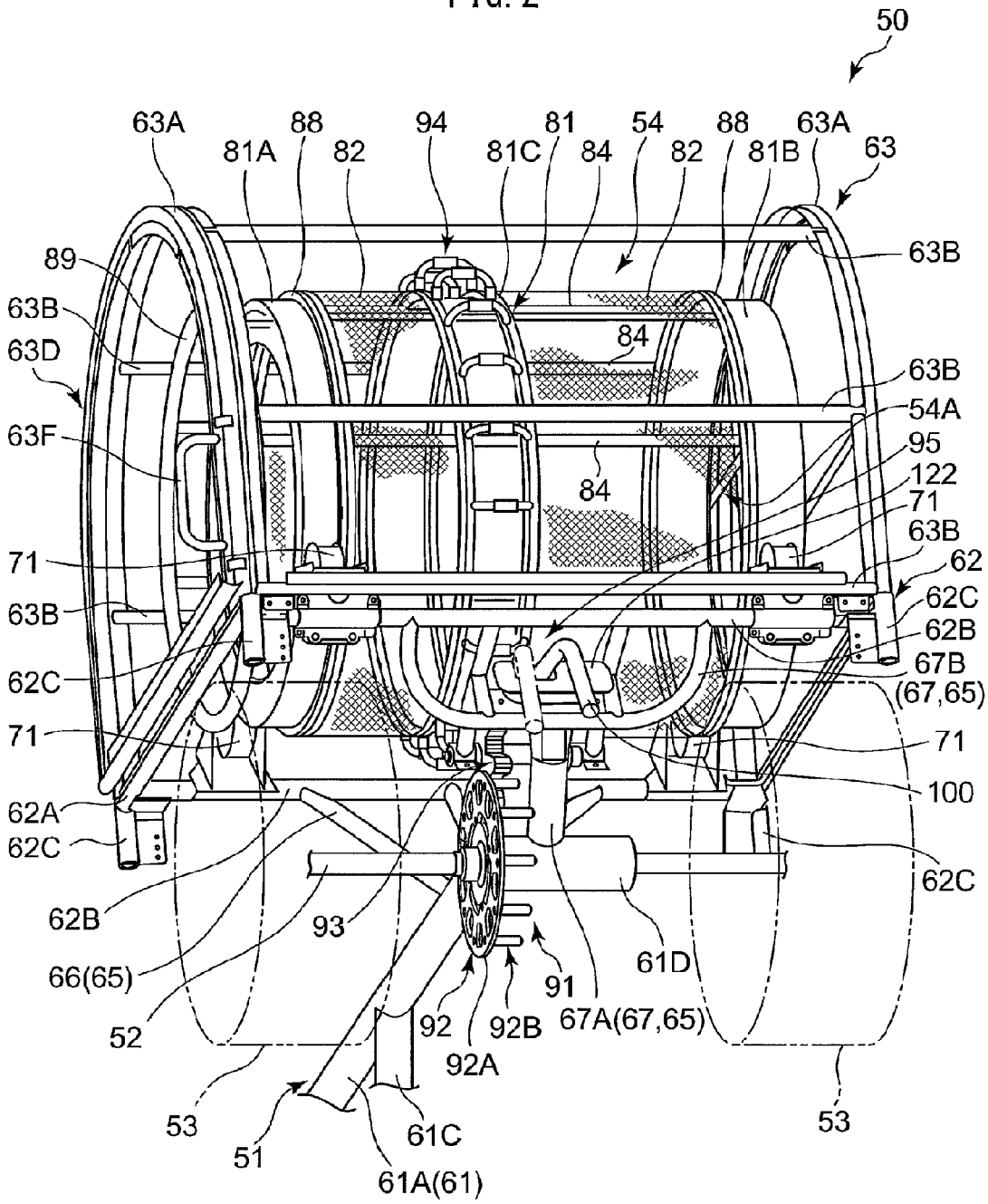
FIG. 2 is a back-side perspective view showing the garbage separation and recovery machine.
Figure 3:
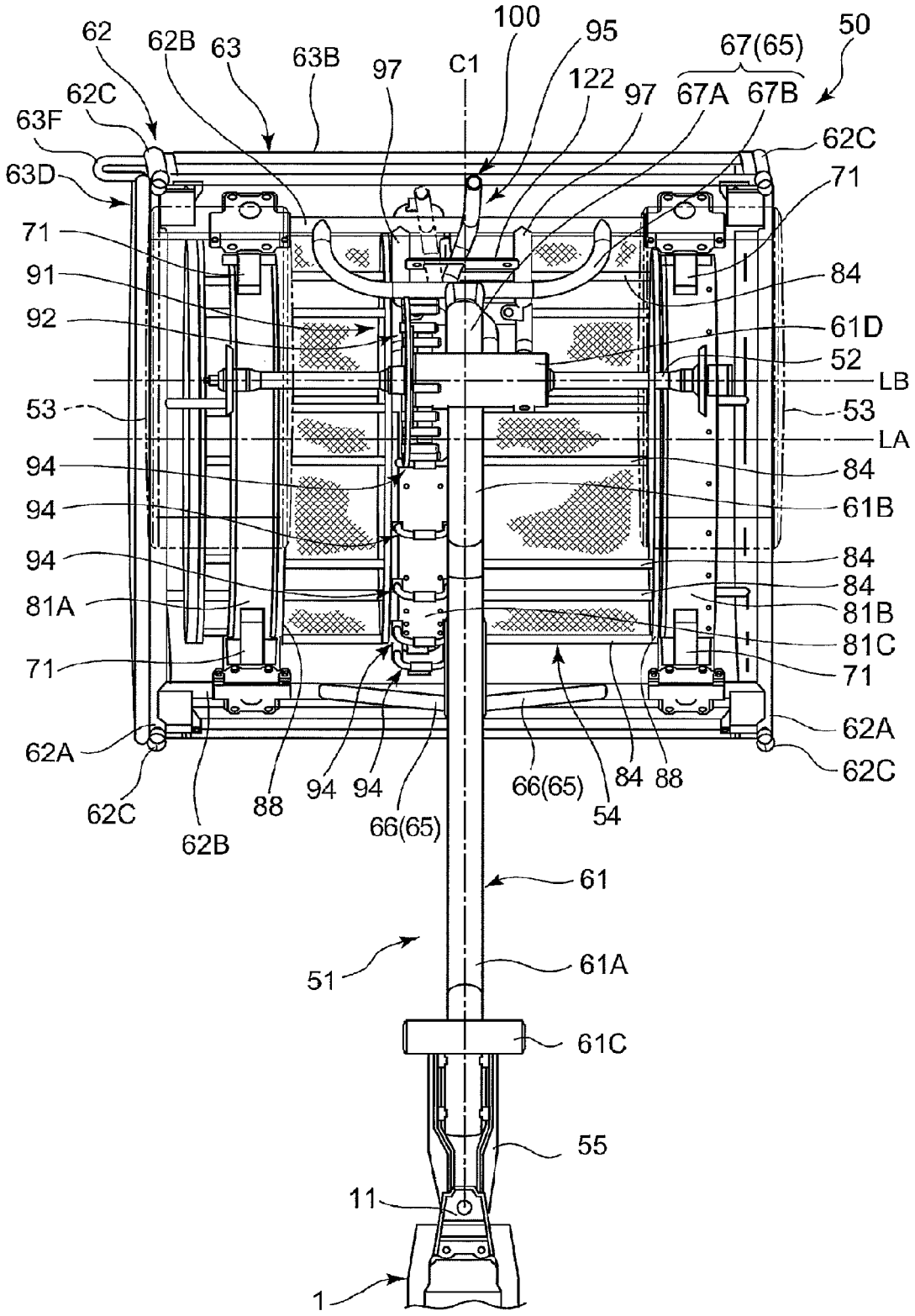
FIG. 3 is a bottom view showing the garbage separation and recovery machine.
Figure 4:
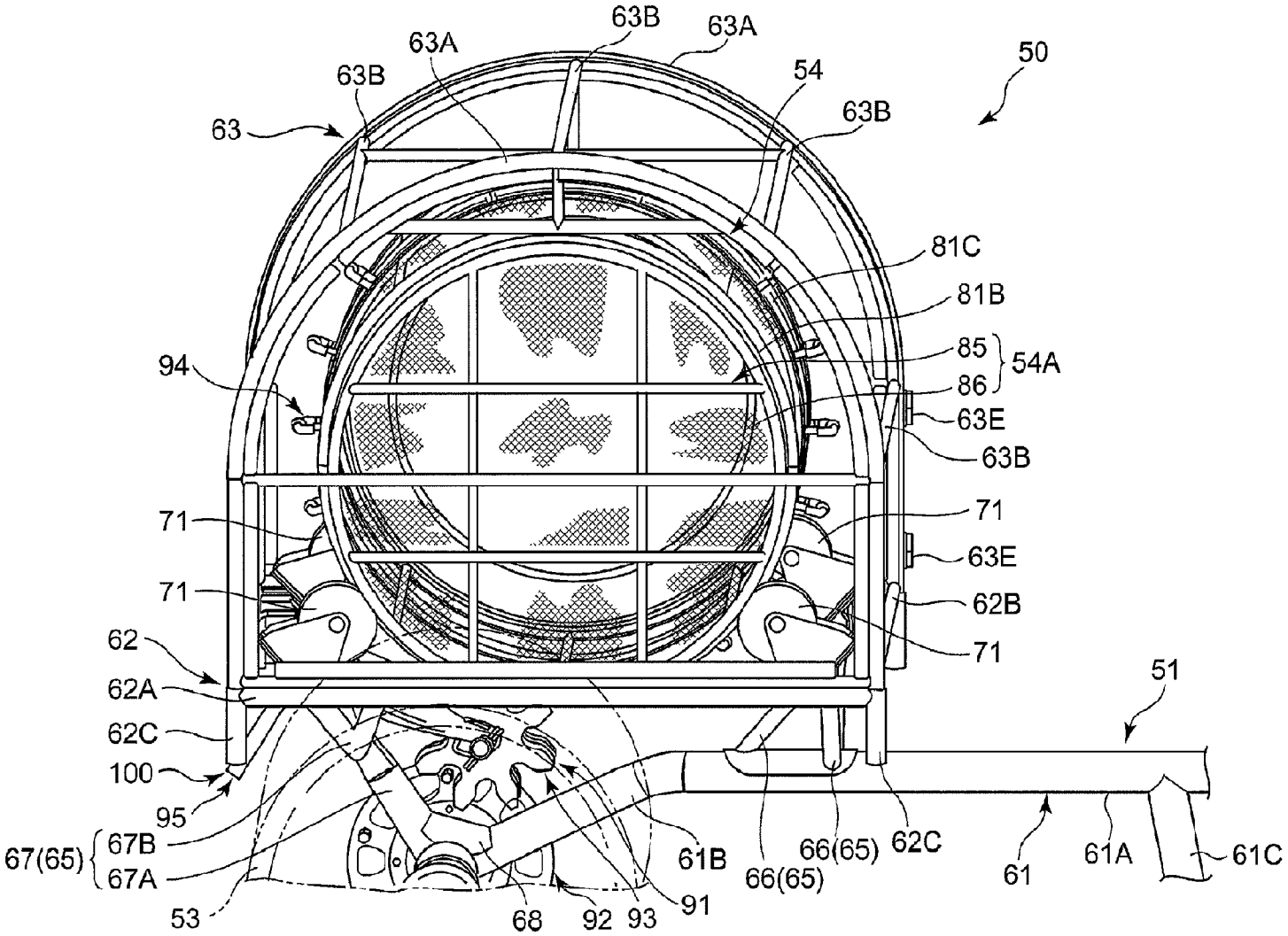
FIG. 4 is a right side view showing the garbage separation and recovery machine.
Figure 5:
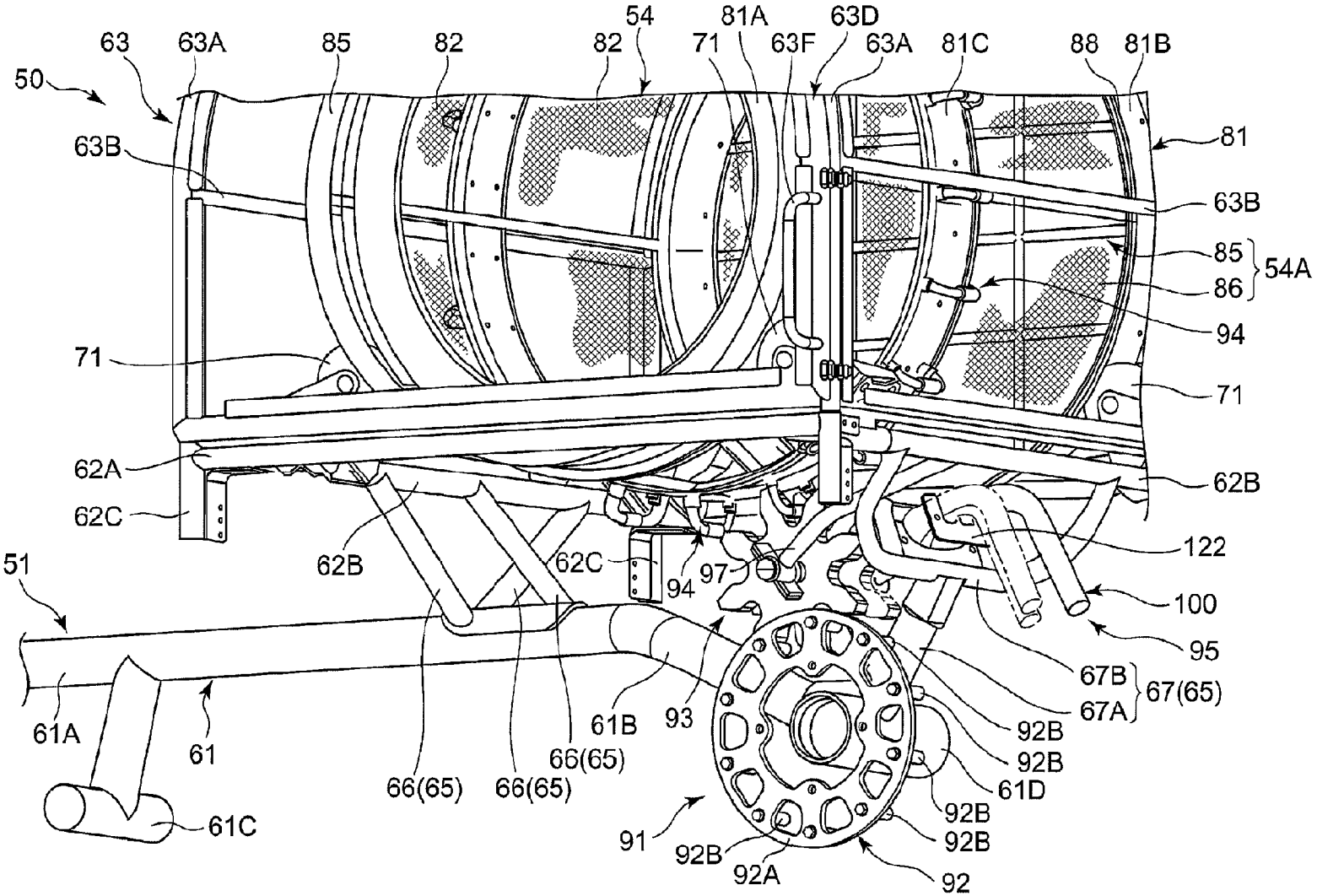
FIG. 5 is a left-side perspective view showing the garbage separation and recovery machine when wheels are detached.

FIG. 2 is a perspective view showing the garbage separation and recovery machine 50 when the garbage separation and recovery machine 50 is viewed from the back side thereof, FIG. 3 is a bottom view, FIG. 4 is a right view and FIG. 5 is a left-side perspective view of the garbage separation and recovery machine 50 when wheels 53 are detached. In FIG. 3, reference character C1 represents the width center of the garbage separation and recovery machine 50, reference character LA represents the axial line (rotational center) of a drum type sieving body 54 as a rotating unit, and reference character LB represents the axial line (rotational center) of an axle 52.

As shown in FIG. 1, the garbage separation and recovery machine 50 has a vehicle body frame 51 towed by a vehicle 1, a pair of right and left wheels 53 secure to the vehicle body frame 51 through an axle 52 (see FIG. 2), and a drum type sieving unit 54 secured to the vehicle body frame 51, and it is an apparatus functioning as a mobile sand separation apparatus for separating sand from garbage gathered by a publicly known beach cleaner.

A joint (also referred to as hitch coupler) 55 that can be secured to the trailer hitch 11 is provided to the front end portion of the vehicle body frame 51 of the garbage separation ad recovery machine 50. The garbage separation and recovery machine 50 is secured to the trailer hitch 11 provided to the rear portion of the vehicle 1 through the joint 55, and enabled to be towed by the vehicle 1.

The vehicle body frame 51 has a single main frame 61 extending in the front-and-rear direction of the vehicle body, a sieving unit support frame 62 supported at the upper side of the main frame 61, and a shield unit 63 covering the periphery of the drum type sieving unit 54 supported by the sieving unit support frame 62. These units are shaped to be symmetrical between the right and left sides with respect to the width center C1 of the garbage separation and recovery machine 50.

As shown in FIG. 1, the main frame 61 has a front portion 61A extending linearly from the joint 55 to the rear side in side view, and a rear portion 61B extending linearly from the rear end of the front portion 61A rearward and downward. As shown in FIG. 3, the main frame 61 is configured so that the front portion 61A and the rear portion 61B linearly extend along the width center C1 of the vehicle body in plan view. The front portion 61A and the rear portion 61B are formed integrally with each other by crooking a single metal pipe.

The front portion 61A is formed to be longer than the rear portion 61B by about several times and extend till a front side of the sieving unit support frame 62 supported at the upper side of the frame 61. An inverse T-shaped stand 61C extending downwards is provided in the neighborhood of the joint 55 of the front portion 61A, and when the joint 55 is detached from the vehicle 1, the stand 61C comes into contact with the ground surface to support the main frame 61 so that the main frame 61 is floated from the ground surface.

As shown in FIGS. 2 and 3, a cylindrical axle support unit 61D for supporting the axle 52 freely rotatably is provided to the rear end of the rear portion 61B. The axle support unit 61D is formed of a cylindrical pipe (metal pipe in this construction) extending in the vehicle width direction, and supports the axle 52 along the vehicle width direction so that the axle 52 is freely rotatable. The axle support unit 61D is provided at the width center C1 of the vehicle body, and supports the center portion of the axle 52.

This axle 52 is rotated integrally with at least one of the right and left wheels 53.

The axle 52 is rigidly joined to one wheel 53 so as to be integrally rotated with the wheel 53, and joined to the other wheel 53 through a wheel lock mechanism 201 so as to be freely locked/unlocked (also referred to as lock/lock free). Therefore, when the garbage separation and recovery machine 50 is towed by the vehicle 1, the axle 52 is rotated at the same rotational number as the wheel 53 in conformity with the rotation of the wheel 53.

Furthermore, in the garbage separation and recovery machine 50, a bearing (ball bearing) 59 described later is added between the other wheel 53 and the axle 52 so as to provide a free hub structure. Therefore, as compared with a case where the right and left wheels 53 are rigidly assembled with each other, the handling performance when the garbage separation and recovery machine 50 is towed can be more remarkably enhanced.

The sieving unit support frame 62 is a frame member for supporting the drum type sieving unit 54 from the lower side, and formed to be symmetrical between the right and left sides with reference to the width center C1 of the vehicle body by assembling plural metal pipes. The sieving unit support frame 62 is supported at the upper side of the main frame 61 through a support frame 65 disposed between the sieving unit support frame 62 and the main frame 61.

As shown in FIGS. 4 and 5, the support frame 65 has a front support frame 66 provided at the front side of the axle 52, and a rear support frame 67 provided at the rear side of the axle 52, and the front support frame 66 is constructed by plural (three in this construction) frame members extending upwards from the rear portion of the front portion 61A of the main frame 61. The front portion of the sieving unit support frame 62 is supported on the main frame 61 by the front support frame 66.

The rear support frame 67 is a frame which extends upwards from the axle support unit 61D serving as the rear end of the main frame 61 and supports the rear portion of the sieving unit support frame 62 from the rear side. The rear support frame 67 has a single frame member 67A extending rearwards and upwards from the center in the width direction of the axle support unit 61D, and a substantially U-shaped branch frame member 67B which bifurcates to the right and left sides from the upper end of the frame member 67A. The support frames 66 and 67 are formed of metal pipes.

In this construction, the sieving unit support frame 62 is supported above the right and left wheels 53 by the front and rear support frames 66 and 67. In this case, the position of the sieving unit support frame 62 in the up-and-down direction is set to be adjacent to the upper edges of the right and left wheels 53. Therefore, the sieving unit support frame 62 is provided at a low position with avoiding interference with the wheels 53, and the drum type sieving unit 54 is provided at a low position at which workability is excellent.

In FIG. 4, reference numeral 68 represents a gusset for bridging the rear portion 61B of the main frame 61 and the lower end of the rear support frame 67, and the joint strength among the main frame 61, the axle support unit 61D and the rear support frame 67 is enhanced by the gusset 68.

As shown in FIG. 2, the sieving unit support frame 62 is formed to have a four-side frame shape which has a pair of right and left front-and-rear extension frames 62A extending in the front-and-rear direction of the vehicle body and a pair of front and rear right-and-left extension frames 62B extending in the right-and-left direction of the vehicle body so as to bridge the front ends of the front and rear extension frames 62A and the rear ends of the front and rear extension frames 62A, respectively. The upper end of the front support frame 66 is joined to the right and left extension frames 62B at the front side, and the upper end of the rear support frame 67 is joined to the right and left extension frames 62B at the rear side.

Cylindrical members 62C extending in the up-and-down direction are joined to the front and rear ends of the pair of right and left front-and-rear extension frames 62A. Accordingly, the metal cylindrical members 62C extending in the up-and-down direction are disposed at four corners existing in the front-and-rear and right-and-left directions of the sieving unit support frame 62. A part of the shield unit 63 enters the cylindrical members 62C from the upper side to position the shield unit 63 to the sieving unit support frame 62.

A pair of right and left guide rollers 71 are freely turnably supported on the pair of front and rear right-and-left extension frames 62B so that the roller axes thereof are aligned with each other in the right and left direction of the vehicle body. As shown in FIG. 4, the cylindrical basket-like drum type sieving unit 54 having a bottom is mounted on these four guide rollers 71 from the upper side, and the drum type sieving unit 54 is supported so that the axial line LA of the sieving unit 54 is set in parallel to the vehicle width direction (see FIG. 3, FIG. 1) and the sieving unit 54 is freely rotatable around the axial line LA.

In this case, as shown in FIG. 4, the front and rear guide rollers 71 are arranged so as to sandwich the lower portion of the drum type sieving unit 54 from the front and rear sides, the frontward and rearward movement of the drum type sieving unit 54 is regulated by the front and rear guide rollers 71, and the drum type sieving unit 54 can be stably supported. The drum type sieving body 54 is merely mounted on the guide rollers 71, so that the drum type sieving unit 54 can be easily detached by lifting up the drum type sieving unit 54.

As shown in FIG. 2, the drum type sieving unit 54 is a large-size part having a cylindrical basket-like shape having a bottom. Garbage mixed with sand which is gathered on the beach by a publicly known beach cleaner is put into the drum type sieving unit 54 and the sand is dropped by rotating the drum type sieving unit 54, whereby only the garbage is left in the sieving unit 54.

The drum type sieving unit 54 has a metal sieving body 81 which has a cylindrical skeleton portion having a bottom and is opened at one end side thereof (the left side in this construction) and blocked at the other end side (right side) by a bottom portion 54A, and a metal mesh member 82 covering the periphery of the sieving body 81.

The sieving body 81 has an opening-side cylindrical portion 81A which cylindrically surrounds an opening-side end portion along the peripheral direction, a blocked-side cylindrical portion 81B which cylindrically surrounds a blocked-side end portion along the peripheral direction, and a middle cylindrical portion 81C which surrounds a middle portion in the axial direction of the sieving body 81 along the peripheral direction, and the cylindrical portions 81A to 81C are formed of cylindrical metal plate members disposed around the axial line LA of the drum type sieving unit 54.

The cylindrical portions 81A to 81C are joined to one another through plural axial-direction extension rods 84 formed of metal steel pipes or metal rods which extend in the direction of the axial line LA of the drum type sieving body 54, and a number of axial-direction extension rods 84 are provided to be spaced from one another in the peripheral direction. A mesh member 82 is secured so as to cover the outer periphery of the sieving body 81 from the outside of the axial-direction extension rods 84.

As shown in FIGS. 4 and 5, a lattice portion 85 formed by assembling metal steel pipes or metal rod portions in a reticular pattern is provided at the blocked-side cylindrical portion 81B so as to surround the opening of the blocked-side cylindrical portion 81B, a metal mesh member 86 is secured to the lattice portion 85 from the outside thereof so as to cover the opening of the lattice portion 85, and the bottom portion 54A of the drum type sieving body 54 is formed by the lattice portion 85 and the mesh member 86.

As described above, the three cylindrical portions (the opening-side cylindrical portion 81A, the middle cylindrical portion 81C, the blocked-side cylindrical portion 81B) are arranged so as to be spaced from one another in the direction of the axial line LA, and the gaps thereamong are covered by the mesh member 82. Therefore, a mesh area functioning as a sieve of the drum type sieving unit 54 can be broadly secured with keeping the mechanical strength. Furthermore, the bottom portion 54A is designed in a reticular pattern, and the openings of the bottom portion 54A are covered by the mesh member 86, so that the bottom portion 54A can also function as a sieve.

The axial-direction extension rods 84 and the lattice portion 85 are members which are located inside the mesh members 82, 86 so as to protrude to the inside of the sieving body 81. Therefore, these members 84, 85 can be made to function as sand pulverizers for pulverizing lumps of sand put into the drum type sieving body 54.

As shown in FIG. 2, the opening-side cylindrical portion 81A and the blocked-side cylindrical portion 81B also function as sliding members on which guide rollers 71 slide. That is, the opening-side cylindrical portion 81A and the blocked-side cylindrical portion 81B have the same diameters and extend to have a predetermined width in the direction of the axial line LA of the drum type sieving unit 54, and the outer peripheral surfaces of the guide rollers 71 come into contact with the opening-side cylindrical portion 81A and the blocked-side cylindrical portion 81B within this width to form sliding faces of the rollers 71. Flange portions 88 protruding to the outer peripheral side are provided integrally with the insides in the width direction of the opening-side cylindrical portion 81A and the blocked-side cylindrical portion 81B, and the positional displacement in the vehicle width direction between each guide roller 71 and the drum type sieving unit 54 is regulated by the flange portions 88.

As shown in FIG. 2, the shield unit 63 is formed to be symmetrical between the right and left sides with respect to the width center C1 of the vehicle body, and is substantially constructed by a pair of right and left side shield members 63A which extend in upwardly-convexed U-shape at the right and left sides of the sieving unit support frame 62 so as to cover the right and left sides of the drum type sieving unit 54, and plural peripheral shield members 63B which extend between the pair of right and left side shield members 63A so as to cover the front, upper and rear sides of the drum type sieving unit 54.

The side shield members 63A are joined to the sieving body support frame 62 by bending metal pipes in U-shape and inserting, from the upper side, both the end portions of the U-shaped metal pipes into the pair of front and rear cylindrical members 62C located at the right and left sides of the sieving body support frame 62.

The peripheral shield members 63B are formed by bridging the front portions, upper portions and rear portions of the pair of right and left side shield members 63A with metal pipes so as to cover the front side, upper side and rear side of the drum type sieving unit 54. The peripheral shield members 63B also function as cross members for reinforcing the pair of right and left side shield members 63A.

As shown in FIG. 2 and FIG. 5, the side shield member 63A located at the opening side (left side) of the drum type sieving unit 54 out of the right and left side shield members 63A is provided with a door member 63D which freely opens and closes the inside opening of the left side shield member 63A. The door member 63D has substantially the same shape as the side shield member 63A, and has a door frame formed of a metal pipe which is joined to the side shield member 63A through a hinge 63E (see FIG. 4) so as to be freely opened and closed. The area surrounded by the door frame is covered by a cover member such as a mesh member or the like, for example.

Therefore, garbage can be restricted from falling out from the opening side of the drum type sieving unit 54 to the outside of the vehicle by the door member 63D, and gathered garbage mixed with sand can be put into the drum type sieving unit 54 by opening the door member 63D. In FIG. 2 and FIG. 5, reference numeral 63F is a grip provided to the door member 63D.

Each figure shows a case where the shield unit 63 is constructed by only the skeleton structure. However, the shield unit 63 may be configured so that the whole outer periphery of the shield unit 63 is covered by a cover member such as a mesh member or the like, whereby scattering of sand from the drum type sieving unit 54 is suppressed by the shield unit 63.

As described above, according to this construction, the drum type sieving unit 54 is freely rotatably supported by the guide rollers 71. Therefore, the drum type sieving unit 54 is rotated under the state that garbage mixed with sand is put in the drum type sieving unit 54, whereby the sand can be efficiently sieved and only garbage which does not pass through the mesh members 82, 84 can be left in the sieving unit 54. Accordingly, only garbage such as drink containers, paper waste, tobacco ashes, etc. remaining on the beach or the like can be left in the drum type sieving unit 54. Furthermore, the drum type sieving unit 54 can be easily rotated with relatively small force.

The garbage separation and recovery machine 50 having the above construction is provided with a mechanism portion (transmission mechanism) 91 for switching an automatic rotation mode in which the drum type sieving unit 54 is rotated by the rotational force of the wheels 53 and a manual rotation mode in which the drum type sieving unit 54 is released from the rotational force of the wheels 53 and allowed to be manually freely rotatable. Therefore, at a place whose ground is leveled to enable towing of the vehicle 1, the garbage separation and recovery work can be performed by the towing force of the vehicle 1 by setting the automatic rotation mode, and at an irregular place at which towing of the vehicle 1 is difficult, the garbage separation and recovery work can be easily performed with human power by setting the manual rotation mode.

The mechanism portion 91 and the peripheral structure thereof will be described.

First, as shown in FIG. 2 and FIG. 5, a metal annular handle 89 is provided to the opening end portion (left-side end portion) of the drum type sieving unit 54 so as to protrude to the outside of the opening end portion in the vehicle width direction. The handle 89 is used as a grip part which a worker grips to easily manually rotate the drum type sieving unit 54 when the drum type sieving unit 54 is allowed to be freely rotatable (corresponding to the manual rotation mode). A person is enabled to grip this handle 89 from the outside by opening the door member 63D, that is, the manual rotation is performed under the state that the door member 63D is opened.

Figure 6:
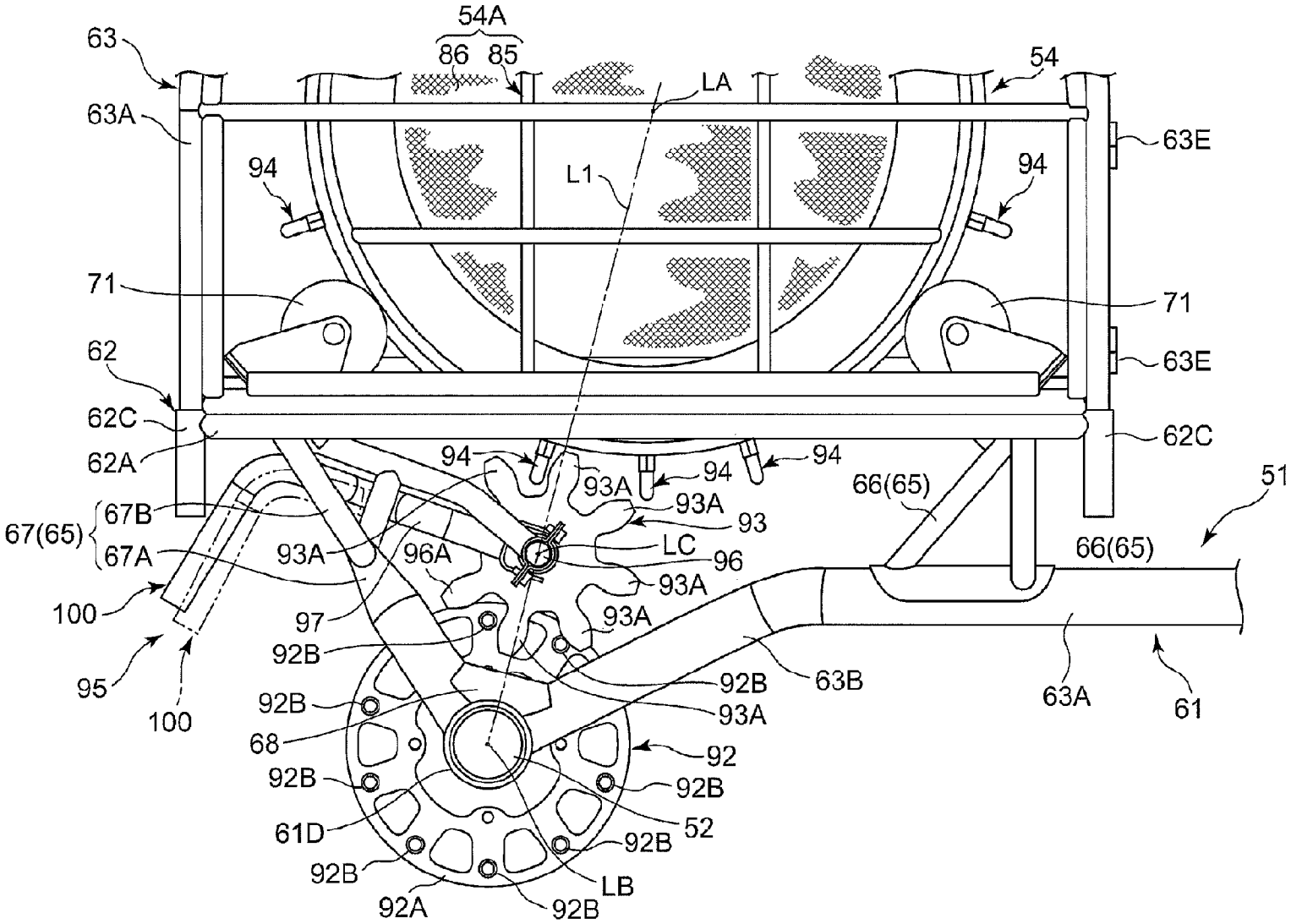
FIG. 6 is a right view showing a mechanical portion of the garbage separation and recovery machine together with the peripheral construction thereof.
Figure 7:
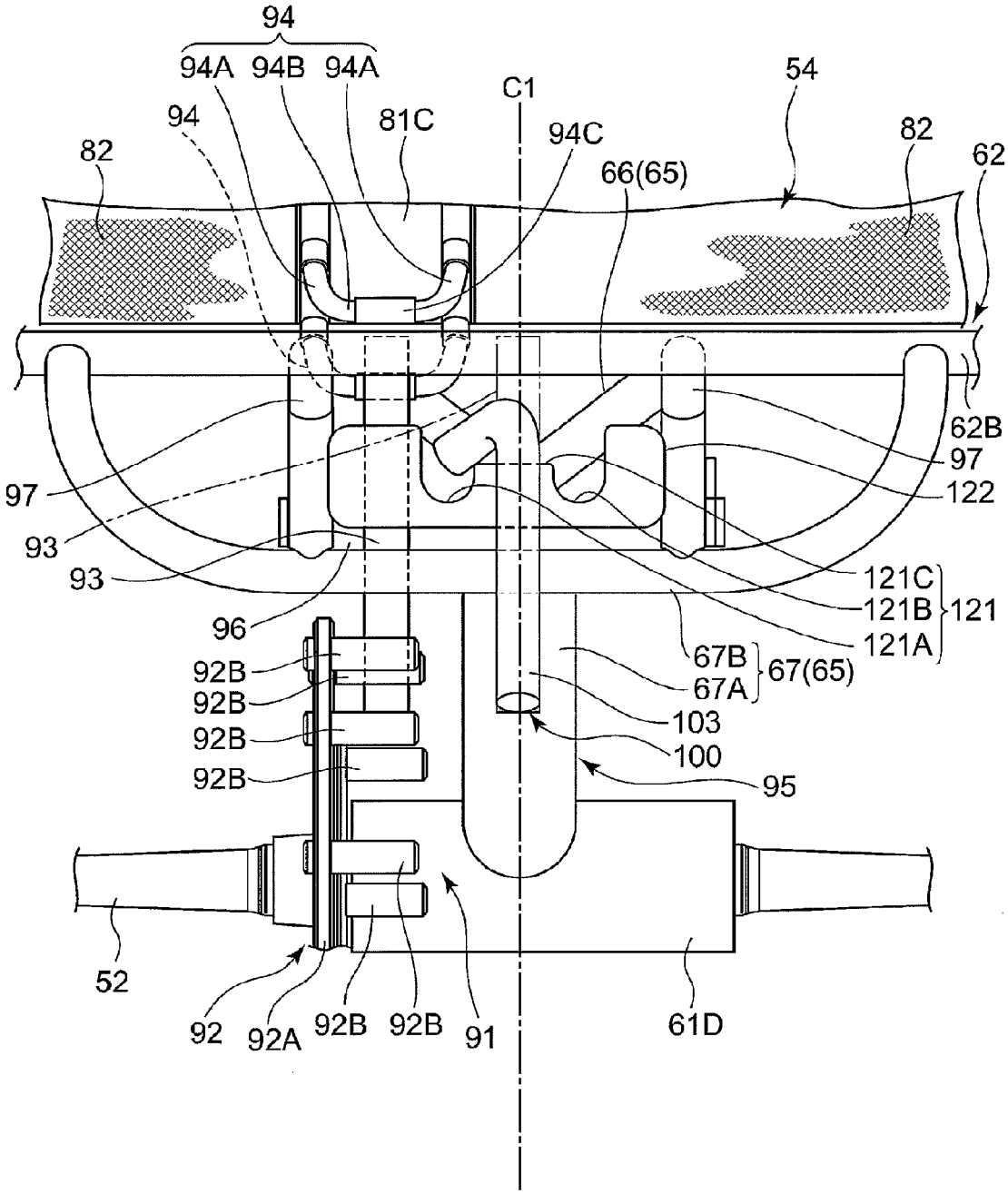
FIG. 7 is a back side view of the mechanical portion together with the peripheral construction thereof.

FIG. 6 is a right side view showing the mechanism portion 91 together with the peripheral construction thereof, and FIG. 7 is a rear view of the mechanism portion 91.

As shown in FIG. 6 and FIG. 7, the mechanism portion 91 has a driving gear 92 secured to the axle 52, a driven gear 93 which is secured to the vehicle body frame 51 and provided to be engageable with and disengageable from the driving gear 92, engagement pieces 94 which are provided to the drum type sieving unit 54 and engaged with the driven gear 93 at the position where the driven gear 93 is engaged with the driving gear 92, and a gear switching mechanism (switching means) 95 for sliding the driven gear 93 to change the gear position.

The driving gear 92 is secured to be rotated integrally with the axle 52. The driving gear 92 is provided to be near to the width center C1 of the vehicle body at a position where the axle 52 is exposed from the axle support unit 61D, and in this construction, the driving gear 92 is provided in the neighborhood of the left end of the axle support unit 61D (see FIG. 7).

More specifically, the driving gear 92 has a metal disc portion 92A increasing in diameter around the axle 52 in the neighborhood of the left end of the axle support unit 61D, and plural rod-like members 92B extending in the axial direction (to the right side) of the axle 52 from the outer periphery of the disc portion 92A so as to be spaced from one another in the peripheral direction of the disc portion 92A which corresponds to the peripheral direction of the driving gear 92. The rod-like members 92B are designed to have the same circular cross-section and extend in the axial direction like a rod, and the tips thereof are located in the neighborhood of the width center C1 of the vehicle body, whereby the center of gravity of the driving gear 92 can be made close to the width center C1 of the vehicle body.

The rod-like members 92B may be formed of metal members, or elastic members such as rubber or the like. When the rod-like members 92B are formed of elastic members, the engagement force between the driving gear 92 and the driven gear 93 can be moderated.

As shown in FIG. 6, a clutch pipe 96 supported by the vehicle body frame 51 is inserted in the driven gear 93 so that the driven gear 93 is freely rotatable and freely slidable in the axial direction, and the driven gear 93 is engaged with and disengaged from the rod-like members 92B of the driving gear 92 by sliding the clutch pipe 96.

Here, the disengagement state from the driving gear 92 means a state that the driven gear 93 is moved to the free end side of the rod-like members 92B and moved to a position at which the driven gear 93 is perfectly evacuated from the rod-like members 92B, the driving gear 92 under this state is represented by a two-dotted chain line in FIG. 7.

As shown in FIGS. 5 and 6, the clutch pipe 96 is a metal pipe extending linearly in parallel to the axle 52, and it is designed to be long to the extent that the driving gear 93 is slidable to the above-described two positions (the engagement position and the disengagement position (or the evacuation position)), and supported through a pair of right and left support frames 97 by the vehicle body frame 51.

The pair of right and left support frames 97 are formed of metal pipes, and the rear ends thereof are joined to the rear-side right-and-left extension frame 62B constituting the rear portion of the sieving unit support frame 62 by welding or the like. The pair of right and left support frames 97 extend frontward and downward from the joint position in side view, and support the clutch pipe 96 in parallel to the axle 52 at the front ends thereof.

As shown in FIG. 6, the driven gear 93 has plural tooth portions 93A which are engaged with the rod-like members 92B of the driving gear 92 and arranged to be spaced from one another in the peripheral direction. These tooth portions 93A are designed to project outwards in the radial direction from the rotational center which is coincident with the axial line LC of the driven gear 93. These tooth portions 93A are designed to be smaller in width than the interval between the adjacent rod-like members 92B of the driving gear 92 in side view, so that each tooth portion 93A enters the gap between the adjacent rod-like members 92B with clearance.

More specifically, the tooth portion 93A of the driven gear 93 is designed so that the base side thereof is gradually wider in side view as it extends outwards in the radial direction and the tip side thereof is gradually narrower in side view as it extends outwards in the radial direction, that is, tapered.

As described above, the tooth portions 93A of the driven gear 93 are tapered. Therefore, the gap space between the tips of the adjacent tooth portions 93A can be made broad, and the rod-like member 92B of the driving gear 92 can be easily received in the gap between the tooth portions 93A of the driven gear 93. Furthermore, when the rod-like member 92B of the driving gear 92 enters the gap between the tooth portions 93A of the driven gear 93, the gap between the tooth portion 93A of the driven gear 93 and the rod-like member 92B of the driving gear 92 can be reduced because the gap is gradually narrowed as the position is nearer to the base end side of the tooth portion 93A, whereby the driven gear 93 and the driving gear 92 can be surely engaged with each other.

According to this construction, even under the state that sand adheres to the driven gear 93 and the driving gear 92, the driven gear 93 and the driving gear 92 can be easily and surely engaged with each other, and the sand is easily dropped therefrom.

As shown in FIG. 6, the engagement pieces 94 are provided on the outer periphery of the middle cylindrical portion 81C forming the skeleton at the intermediate portion in the axial direction of the drum type sieving unit 54 so as to be spaced from one another at regular intervals in the peripheral direction. As shown in FIG. 7, the engagement pieces 94 are U-shaped projecting members projecting outwards in the radial direction, and each of the engagement pieces 94 is formed by bending a metal pipe so that it is integrally provided with a pair of right and left rod-like support portions 94A projecting outwards in the radial direction from the outer periphery of the sieving unit 54 and a rod-like member (projection end) 94B extending in the axial line LA direction so that the outermost ends of the pair of right and left support portions 94A are joined to each other.

In FIG. 7, reference numeral 94C represents an elastic member such as rubber or the like which is mounted on the rod-like member 94B so as to be wound around the outer periphery of the rod-like member 94B. The engagement force between the engagement piece 94 and the driven gear 93 is moderated by the elastic member 94C.

As shown in FIG. 7, the rod-like members 94B of the engagement pieces 94 are located above the rod-like members 92B of the driving gear 92, and overlapped with the rod-like members 92B of the driving gear 92 in plan view as shown in FIG. 3. The driven gear 93 is configured to be freely inserted into and retracted from the gap between the rod-like member 94B of the engagement piece 94 and the rod-like member 92B of the driving gear 92 along the clutch pipe 96. Accordingly, as shown in FIG. 7, the lower portion of the driven gear 93 is engaged with the rod-like members 92B of the driving gear 92, and the lower portion of the driven gear 93 is engaged with the rod-like members 94B of the engagement pieces 94.

In this case, as shown in FIG. 6, when the tooth portion 93A located at the lower end of the driven gear 93 enters the gap between the adjacent rod-like members 92B of the driving gear 92, the tooth portion 93A located at the upper end of the driven gear 93 enters the gap between the adjacent engagement pieces 94 (the rod-like members 94B) and the driving gear 92 is rotated by rotation of the wheels 53, the drum type sieving unit 54 is rotated through the driven gear 93.

In this construction, as shown in FIG. 6, the interval between the adjacent engagement pieces 94 is set to a large interval at which plural (two in this construction) tooth portions 93A of the driven gear 93 are put therebetween. Therefore, the rotation of the driven gear 93 is decelerated and then transmitted to the drum type sieving unit 54, whereby the rotational speed of the drum type sieving unit 54 is decelerated to a desired speed suitable for sieving. Furthermore, a large gap is formed between the engagement piece 94 and the driven gear 93, and thus even when sand dropping from the drum type sieving unit 54 adheres to the engagement pieces 94 or the driven gear 93, the rotation of the drum type sieving unit 54 through the driven gear 93 is not disturbed.

In addition, as described above, the tooth portions 93A of the driven gear 93 are formed to be tapered, so that the gap space between the tips of the adjacent tooth portions 93A can be made broad. Therefore, the engagement piece 94 easily enters the gap space, and the driven gear 93 and the engagement piece 94 are easily engaged with each other. Even when sand adheres to the driven gear 93 and the engagement piece 94, they can be easily engaged with each other.

In this construction, the axial line LA as the rotational center of the drum type sieving unit 54 is located at a position which is above the axle 52 (the axial line LB) and displaced from the axle 52 (the axial line LB) in the front-and-rear direction (in this construction, the axial line LA of the drum type sieving unit 54 is displaced to the front side of the axle 52 (the axial line LB)). The axial line LC as the rotation center of the driven gear 93 is located between the axial line LA of the drum type sieving unit 54 and the axle 52 (the axial line LB) in side view.

Therefore, the driven gear 93 can be disposed by using an empty space between the drum type sieving unit 54 and the axle 52, the mechanism portion 91 can be disposed in compact size, and the drum type sieving unit 54, the driven gear 93 and the axle 52 can be disposed more compactly in the up-and-down direction as compared with a case where they are arranged vertically in the up-and-down direction.

In addition, according to this construction, the axial line LC as the rotation center of the driven gear 93 is located on a line L1 which connects the axial line LA as the rotation center of the drum type sieving body 54 and the axle 52 (the axial line LB). Therefore, the driving gear 92, the driven gear 93 and the drum type sieving unit 54 are arranged on the line L1, and thus they can be efficiently arranged in proximity to one another.

As shown in FIG. 1, the driven gear 93 is overlapped with the wheels 53 in side view. Therefore, the space between the wheels 53 can be efficiently used, and the right and left sides of the driven gear 93 can be guarded by the wheels 53.

Furthermore, in the layout of this construction, the rear portion 61B of the main frame 61 is located at the front lower side of the driven gear 93, and the rear support frame 97 is located at the rear lower side as shown in FIG. 6, so that the driven gear 93 can be guarded from the lower side by using the existing frame members. Furthermore, the front support frame 66 is located at the front side of the driven gear 93, and the rear support frame 97 is located at the rear side of the driven gear 93. Therefore, the front and rear sides of the driven gear 93 can be guarded by the support frames 66 and 67.

The gear switching mechanism (switching means) 95 will be described.

Figure 8:
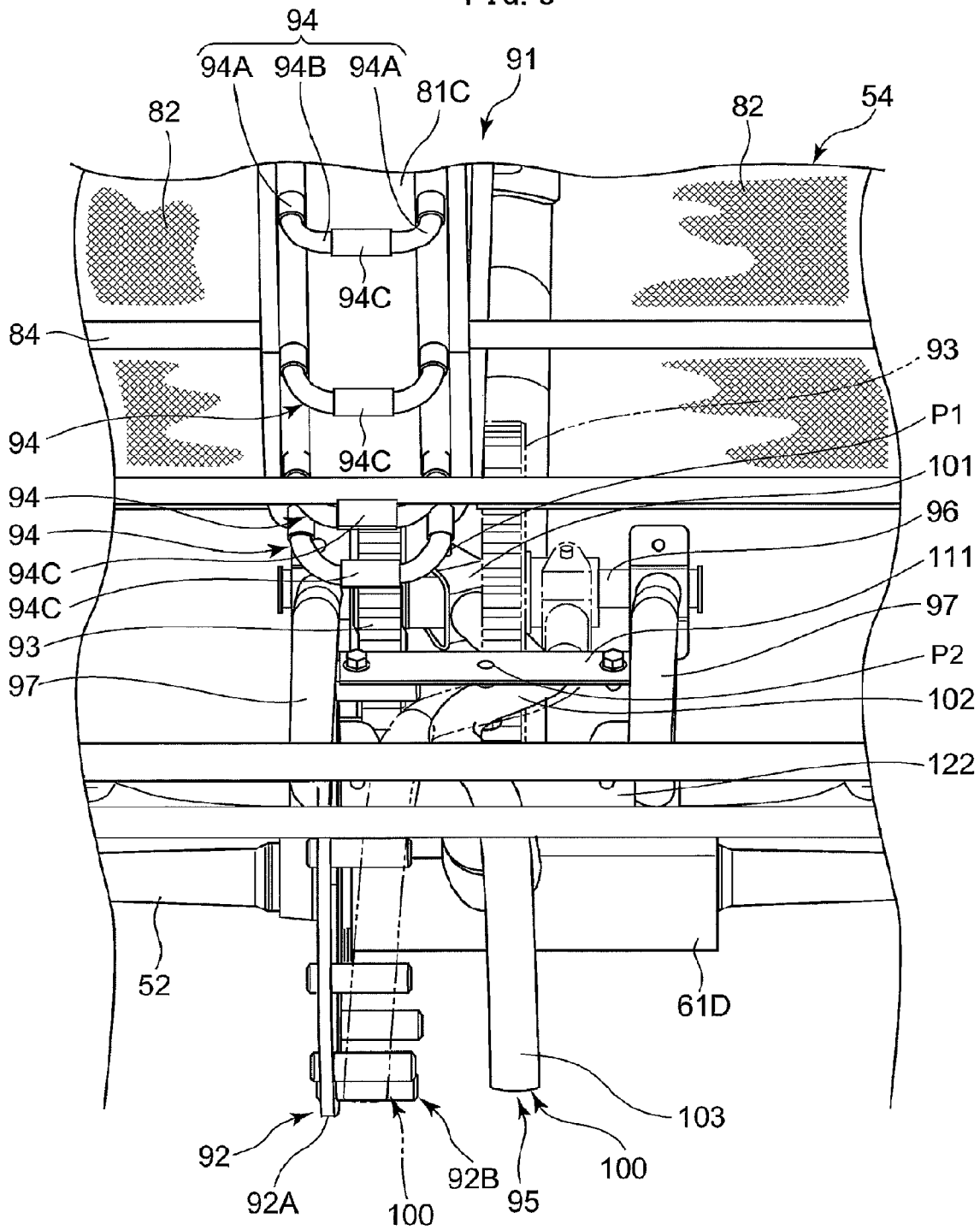
FIG. 8 is a diagram showing a gear switching mechanism of the garbage separation and recovery machine together with the peripheral construction thereof when the gear switching mechanism is viewed from an upper rear side.
Figure 9:
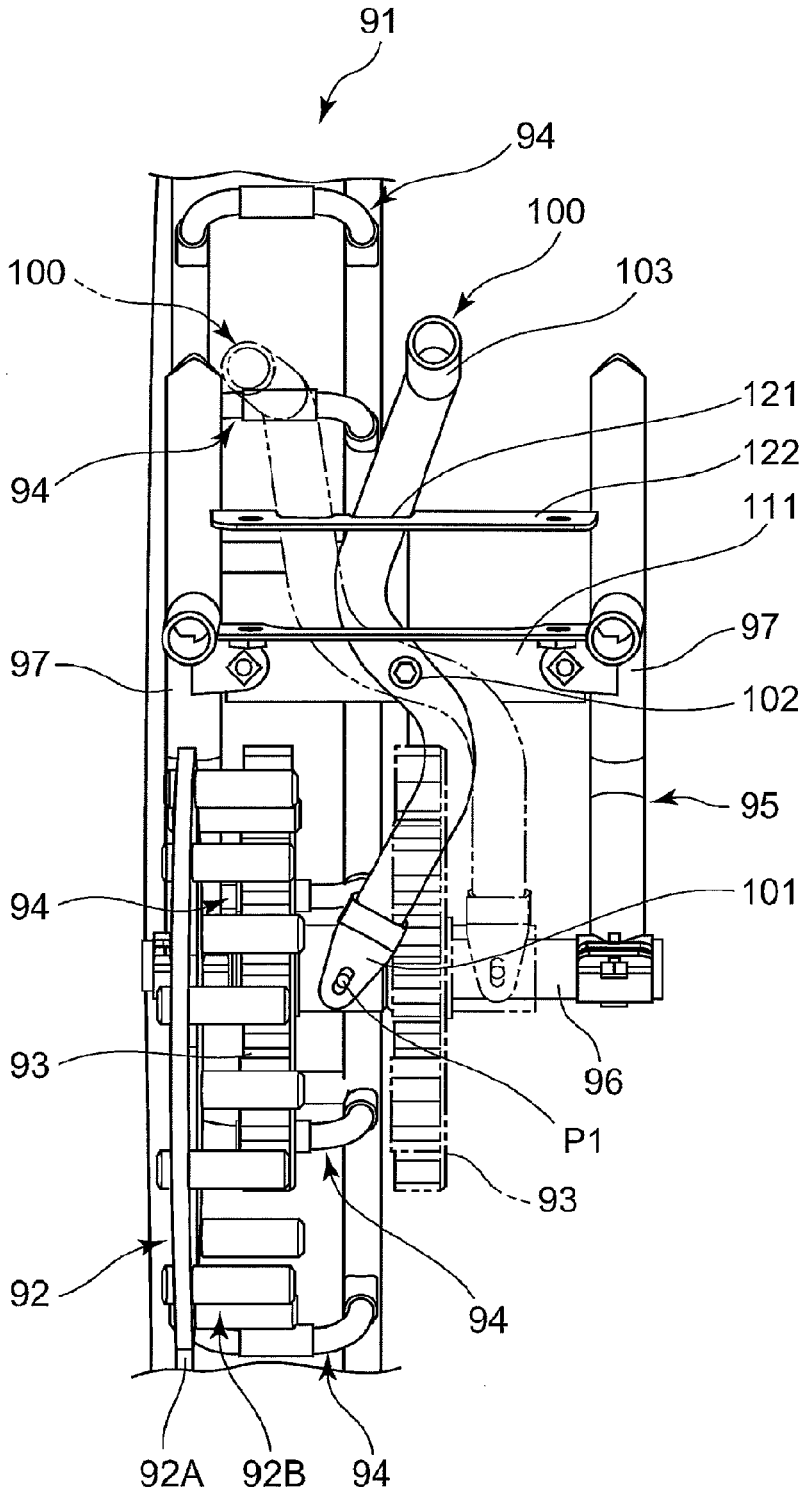
FIG. 9 is a bottom view of the gear switching mechanism together with the peripheral construction thereof.

FIG. 8 is a view taken when the gear switching mechanism 95 is viewed from the upper rear side together with the peripheral construction thereof, and FIG. 9 is a view taken from the lower side.

As shown in FIGS. 8 and 9, the gear switching mechanism 95 has an operation lever 100 for sliding the driven gear 93 in the axial direction of the clutch pipe 96. As shown in FIG. 9, the operation lever 100 is formed of a metal pipe which is crooked in a substantially Z-shape in plan view. The top portion 101 of the operation lever 100 is joined to a cylindrical portion 93C integrated with the driven gear 93, a middle portion 102 of the operation lever 100 is joined to a cross plate 111 which is bridged between the pair of right and left support frames 97 for supporting the clutch pipe 96, and the base portion 103 of the operation lever 100 is crooked downwardly and formed as a grip portion which the worker grips.

Here, the joint portion between the tip portion 101 of the operation lever 100 and the driven gear 93 is designed as an universal joint, and the operation lever 100 is freely turnable in the right-and-left direction and freely swingable in the up-and-down direction with a pin P1 of the joint portion (see FIG. 9) as a fulcrum. Furthermore, the joint portion between the middle portion 102 of the operation lever 100 and the cross plate 111 is designed as an universal joint, and the operation lever 100 is freely turnable in the right-and-left direction and freely swingable in the up-and-down direction with a pin P2 of the joint portion (see FIG. 8) as a fulcrum.

Therefore, as shown in FIG. 9, by turning the operation lever 100 in the right-and-left direction, the driven gear 93 can be moved between a position where the driven gear 93 and the driving gear 92 are engaged with each other (a position indicated by a solid line) and a position where the driven gear 93 and the driving gear 92 are not engaged with each other (a non-engagement position, a position indicated by a two-dotted chain line).

In FIG. 8 and FIG. 9, the driven gear 93 and the operation lever 100 when the driven gear 93 is moved to the position where the driven gear 93 is engaged with the driving gear 92 are represented by a solid line, and the driven gear 93 and the operation lever 100 when the driven gear 93 is moved to the non-engagement position is represented by a two-dotted chain line.

As shown in FIG. 9, a plate-like gate member 122 having a fitting groove 121 (see FIG. 7) in which the operation lever 100 is fitted is provided at the rear side of the cross plate 111 of the vehicle body frame 51.

As shown in FIG. 7, the fitting groove 121 of the gate member 122 has a pair of right and left deep groove portions 121A, 121B extending downwardly so as to be spaced from each other in the right-and-left direction, and a shallow groove 121C which is shallower than the pair of right and left deep groove portions 121A, 121B and through which the upper half portions of the deep groove portions 121A, 121B are connected to each other in the right-and-left direction. The deep groove portion 121B at one side (right side) out of the pair of right and left deep groove portions 121A, 121B is formed as a fitting groove in which the operation lever 100 is fitted when the driven gear 93 is moved to the engaging position with the driving gear 92, and the deep groove portion 121A at the other side (left side) is formed as a fitting groove in which the operation lever 100 is fitted when the driven gear 93 is moved to the non-engagement position.

That is, the fitting groove 121 functions as a gate groove for guiding the driven gear 93 to the engagement position and the non-engagement position through the operation lever 100. When the worker gripping the operation lever 100 moves the operation lever 100 along the fitting groove 121 in the right-and-left direction, the operation lever 100 can be moved to any one of the deep groove portions 121A and 121B. Furthermore, the operation lever 100 is designed to be large in weight at the base end portion 103 as the grip portion side, and when the worker releases the operation lever 100 from his/her hand under the state that the operation lever 100 is moved to any one of the deep groove portions 121A and 121B, the operation lever 100 moves to the lower portion of the deep groove portion 121A, 121B by its own weight.

When the operation lever 100 is operated to the deepest portion of the deep groove portion 121A, 121B, the movement of the operation lever 100 in the right-and-left direction is restricted, so that the operation lever 100 can be held at the engagement position or the non-engagement position. Accordingly, the operation lever 100 can be easily switched to the automatic rotation mode position at which the drum type sieving unit 54 is rotated by the rotational force of the vehicle 1 and the manual rotation mode position at which the drum type sieving unit is released from the rotational force of the vehicle and allowed to be manually freely rotatable, and also kept at that position. The operation lever 100 functions as a switching lever for switching the automatic rotation mode and the manual rotation mode to each other.

Next, a wheel lock mechanism 201 for locking/unlocking the axle 52 and the wheels 53 will be described together with the peripheral construction thereof.

FIGS. 10 to 13 are side cross-sectional views showing the wheel lock mechanism 201 together with the peripheral construction thereof. In the figures, reference numeral 56 represents a wheel body of the wheel 53, and the wheel body 56 is a two-piece wheel comprising a cylindrical rim portion 56A on which a rubber tire is secured, and a wheel disk portion (bridging portion) 56B for bridging the gap of the rim portion 56A, and it is formed of metal material such as aluminum alloy, iron or the like.

A metal hub portion 57 is secured to the inner surface in the vehicle width direction of the wheel disc portion 56B by a fastening member (a fastening bolt and a nut in this embodiment) 58, and the axle 52 is freely rotatably supported through a bearing (ball bearing) 59 by the hub portion 57. Accordingly, the wheel body 56 and the axle 52 are joined to each other so as to be freely rotatable relatively to each other.

The wheel lock mechanism 201 has a slide shaft 201A mounted on the end portion of the axle 52, a disc portion 202 provided integrally with or separately from the hub portion 57, a slide member 20X which is freely movable to the disc portion 202, and a snap ring 205 for moving the slide member 20X to predetermined different two positions (a lock position and an unlock position described later). The slide member 20X has a slider 203 which is freely movable to the disc portion 202, and a lock pin 204 which is provided to the slider 203 and freely engaged with the disc portion 202. These parts are formed of metal materials such as aluminum alloy, iron or the like.

The slide shaft 201A is a cylindrical part in which the axle 52 is inserted, and rotates integrally with the axle 52. The bearing 59 is provided between the slide shaft 201A and the hub portion 57, and the slide shaft 201A and the hub portion 52 are provided to be freely rotatable relatively through the bearing 59.

Figure 14:
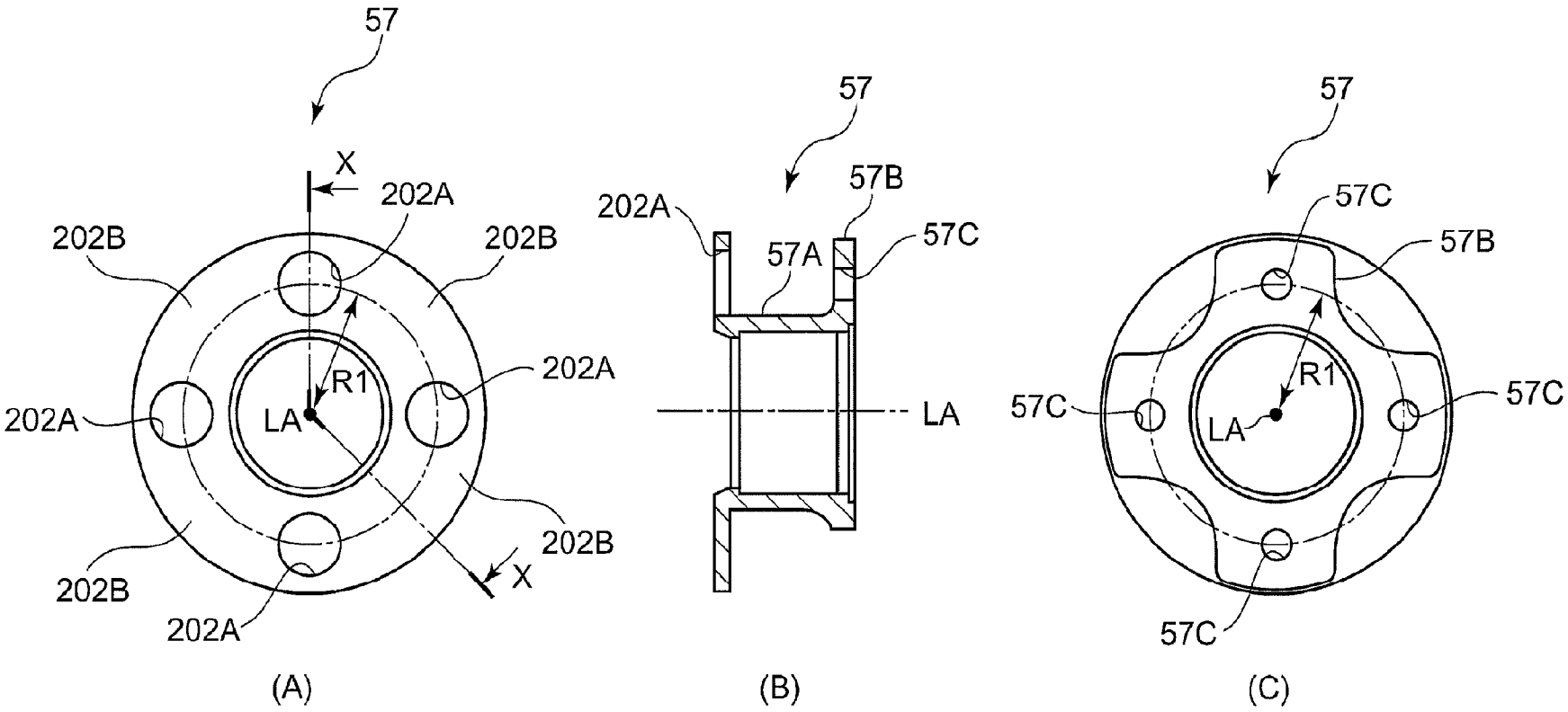
FIG. 14(A) is a left side view of a hub portion 57.
FIG. 14(B) is a cross-sectional view (X-X cross-sectional view of FIG. 14(A))
FIG. 14(C) is a right side view.
Figure 15:
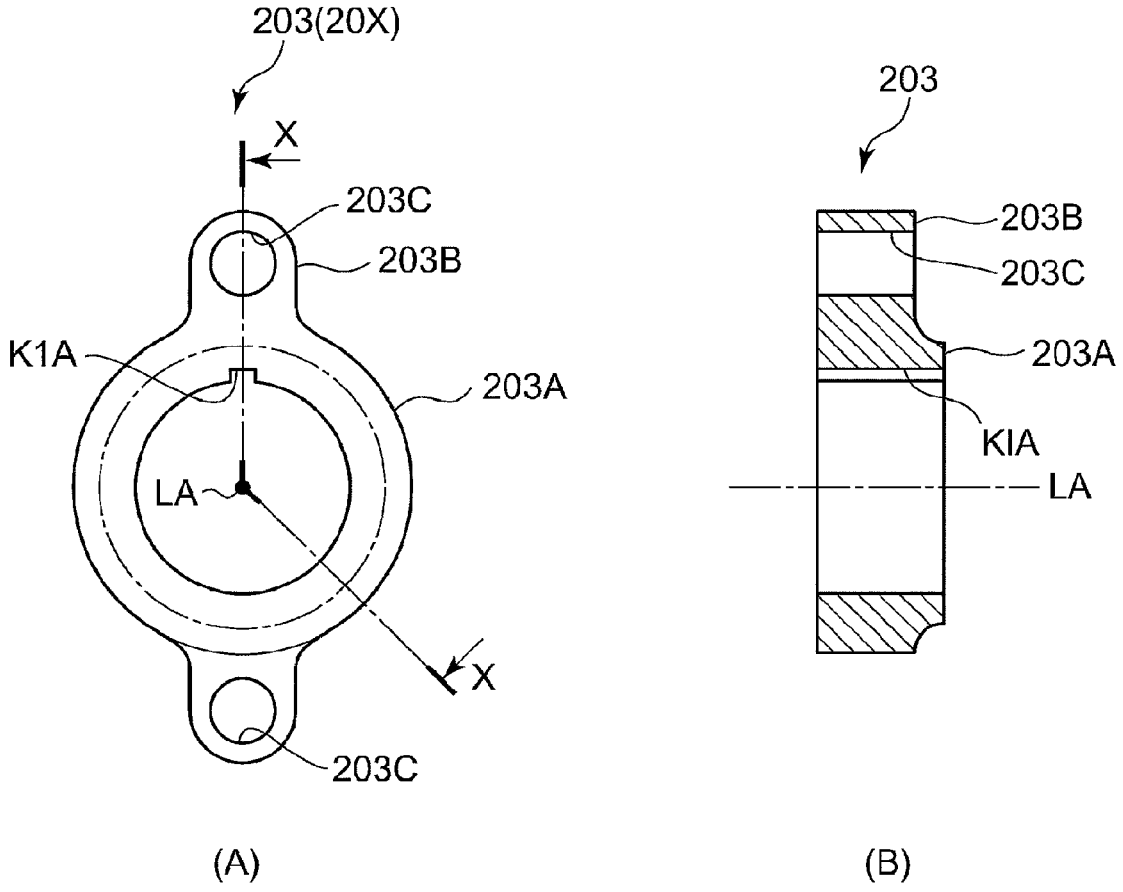
FIG. 15(A) is a left side view of a slider.
FIG. 15(B) is a cross-sectional view (X-X cross-sectional view of FIG. 15(A)).

Here, FIGS. 14(A) to (C) are left side view, cross-sectional view (X-X cross-sectional view of FIG. 14(A)) and right side view of the hub portion 57, and FIGS. 15(A), (B) are left side view and cross-sectional view (X-X cross-sectional view of FIG. 15(A)) of the slider 203. Furthermore, FIGS. 16(A) (B) (C) (D) represent the snap ring 205, FIGS. 16(A) (B) are left side view and cross-sectional view (X-X cross-sectional view of FIG. 16(A)) of the snap ring 205, and FIGS. 16(C) (D) are views obtained when FIG. 16(A) is viewed from Y, Z directions, respectively.

As shown in FIGS. 14(A) to (C), the hub portion 57 has a cylindrical cylinder portion 57A functioning as a pivot support portion for supporting the outer ring of the bearing 59 (see FIG. 10), and a flange portion 57B which spreads outwards in the radial direction of the cylinder portion 57A so as to have a cross-shaped cross-section of 90° angular interval in side view (see FIG. 14(C)) is provided integrally with the outer end in the vehicle width direction of the cylinder portion 57A. The flange portion 57B is provided with hole portions 57C through which fastening members (bolts) 58 (see FIG. 10) are inserted, and the hole portions 57C are formed to be arranged at equal angular intervals (90° angular intervals in this embodiment) and located at the equal distance R1 from the axial line LA (=the axial line of the cylinder portion 57A). The hub portion 57A is fixed to the wheel body 56 by plural (four) fastening members 58.

The disc portion 202 is provided integrally with the inner end in the vehicle width direction of the cylinder portion 57, formed to increase in diameter from the outer peripheral surface of the cylinder portion 57A and designed in a circular flange shape around the axial line LA. The disc portion 202 is provided with hole portions 202A to which the lock pin 204 is fitted and which are formed to be spaced from one another at equal angular intervals (90° intervals in this embodiment) and located at the equal distance R1 from the axial line LA (=the axial line of the cylinder portion 57A).

The plural hole portions 202A are provided to be located at the same phase positions as the hole portions 57C provided to the flange portion 57B. A tool is inserted from the hole portions 202A at the disc portion 202 side, whereby the fastening members 58 provided to the hole portions 57C at the flange portion 57B side can be fastened. The area between the hole portions 202A of the disc portion 202 is set as a non-penetration portion 202B which does not penetrate through the disc portion 202.

As shown in FIGS. 15(A) (B), the slider 203 is integrally provided with a cylindrical cylinder portion 203A through which the slide shaft 201A is inserted, and protrusion portions 203B projecting outwards in the radial direction from the outer peripheral surface of the cylinder portion 203A, and it is provided to be freely movable in the axial direction inside the disc portion 202 in the vehicle width direction.

The cylinder portion 203A is formed so that the inner diameter thereof is substantially equal to the outer diameter of the slider shaft 201A (the outer diameter of the slide shaft 201A inside the disc portion 202 in the vehicle width direction), and the slide shaft 201A is inserted in the cylinder portion 203A so that the cylinder portion 203A is freely movable in the axial direction relatively to the slide shaft 201A. A key groove K1A through which a key K1 (see FIG. 10) fixed to the slide shaft 201A passes is provided on the inner peripheral surface of the cylinder portion 203A. The slider 203 is guided to be movable in the axial direction of the slide shaft 201A, that is, only in the axial direction of the axle 52 by the key K1.

Figure 10:
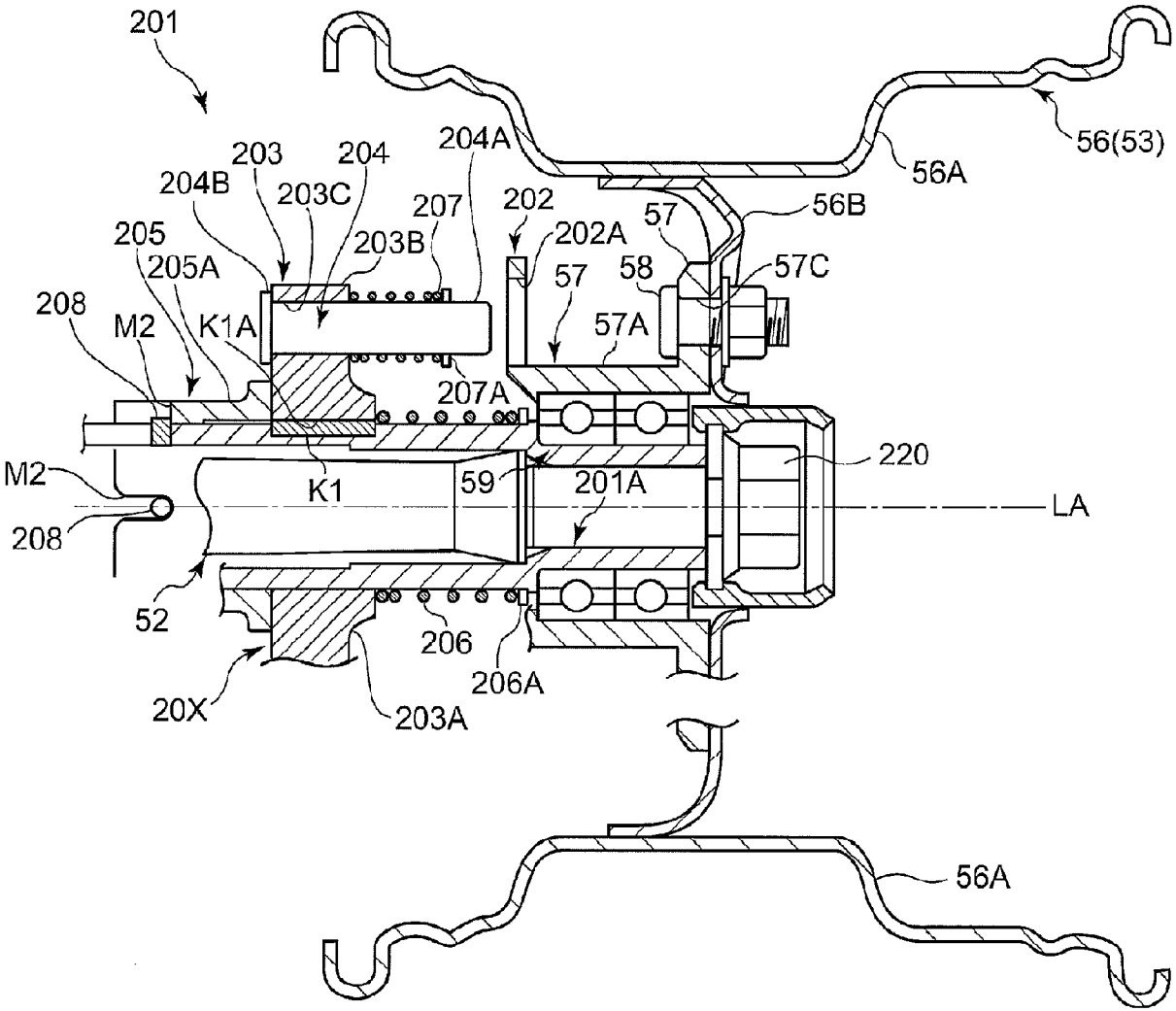
FIG. 10 is a side view showing a wheel lock mechanism under an unlock state together with the peripheral construction thereof.

As shown in FIG. 10, a return spring (urging member for returning) 206 is interposed between the cylinder portion 203A and the bearing 59 of the hub portion 57, and the slider 203 is urged to the opposite side to the disc portion 202 along the axial direction by the return spring 206.

A coil spring having substantially the same diameter as the axle 52 is used as the return spring 206, and the axle 52 is inserted through the return spring 206 between the cylinder portion 203A and the hub portion 57. Accordingly, the return spring can be disposed in a narrow space surrounded by the cylinder portion 203A, the hub portion 57, the axle 52 and the lock pin 204, and the lock pin 204 can be supported without providing any dedicated support member. In the figures, reference numeral 206A represents a spring receiving member (also referred to as stopper) for receiving one end of the return spring 206 (the end portion at the opposite side to the slider 203).

As shown in FIG. 15(A), the protrusion portions 203B are provided at an angular interval of 180° around the axial line LA (=the axial line of the slide shaft 201A and the cylinder portion 203A). Each protrusion portion 203B is provided with a through hole 203C penetrating in the axial direction, and each lock pin 204 is held in each through hole 203C. Each of the plural (two in this construction) lock pins 204 is integrally provided with a shaft portion 204A which has substantially the same diameter as the through hole 203C and is longer than the whole length of the through hole 203C, and a flange portion 204B which increases in diameter at the base portion 204A thereof. The lock pin 204 is inserted through the through hole 203C so that the tip of the shaft portion 204A is directed to the outside in the vehicle width direction, and held in the slider 203 so as to be freely movable in the axial direction. Furthermore, the lock pin 204 is prevented from dropping out to the outside in the vehicle width direction by the flange portion 204B.

The lock pin 204 is inserted through a lock pin spring (urging member for locking) 207 (see FIG. 10). One end (the inside end portion in the vehicle width direction) of the lock pin spring 207 comes into contact with the end face of the slider 203, and the other end (the outside end portion in the vehicle width direction) of the lock pin spring 207 is fixed to the shaft portion 204A of the lock pin 204 through a spring receiving member (also referred to as a stopper) 207A, whereby the lock pin 204 is urged to the outside in the vehicle width direction with respect to the slider 203, that is, urged to the disc portion 202.

A coil spring having substantially the same diameter as the shaft portion 204A of the lock pin 204 is used as the lock pin spring 207, and the lock pin 204 can be supported without providing any dedicated support member.

As shown in FIGS. 16(A) (B), the snap ring 205 has a cylindrical cylinder portion 205A through which the slide shaft 201A is passed, and it is provided to be freely movable in the axial direction of the axle 52 and freely rotatable in the peripheral direction of the axle 52 inside the slider 203 in the vehicle width direction. The cylinder portion 205A is integrally provided with a contact-side cylinder portion 205B which is brought into contact with the slider 203, and a non-contact side cylinder portion 205C which is continuous with the inside in the vehicle width direction (the opposite side to the slider 203) of the contact-side cylinder portion 205B and whose inner diameter is smaller than the inner diameter of the contact-side cylinder portion 205B.

The contact-side cylinder portion 205B is formed so that the inner diameter thereof is larger than the diameter of the slide shaft 201A (see FIG. 10), and also formed so as to be freely rotatable and movable in the axial direction without coming into contact with the key K1 fixed to the slide shaft 201A. A flange portion 205D which increases in diameter to the outside in the radial direction is formed integrally to the open-side end portion of the contact-side cylinder portion 205B, whereby the contact area between the flange portion 205D and the slider 203 is kept broad.

The non-contact side cylinder portion 205C is formed so that the inner diameter thereof is equal to the inner diameter of the slider 203 (=the outer diameter of the axle 52), and it is also formed so as to be smoothly freely rotatable along the outer peripheral surface of the slide shaft 201A and freely movable in the axial direction to the extent that it does not come into contact with the key K1. Lock groove portions (short groove portions) M1 and unlock groove portions (long groove portions) M2 which extend in the axial direction are formed on the non-contact side cylinder portion 205C so as to be spaced from one another at equal angular intervals (45° intervals in this construction) around the axial line LA (=the axial line of the cylinder portion 205A).

As shown in FIG. 10, a stopper pin 208 projecting outwards in the radial direction from the slide shaft 201A is fixed to the slide shaft 201A, and the stopper pin 208 is fitted to any one of the lock groove portions M1 and the unlock groove portions M2.

Figure 13:
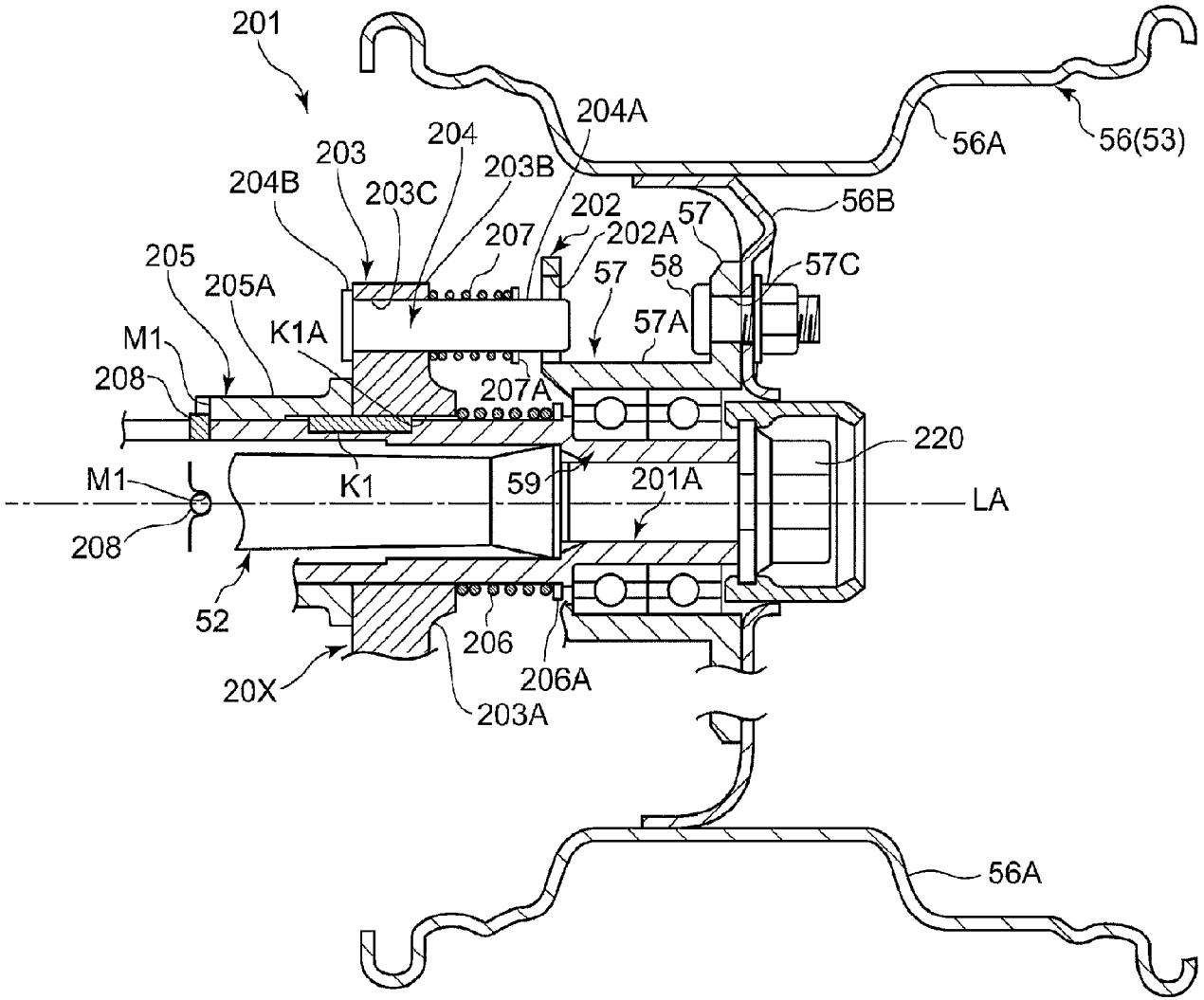
FIG. 13 is a side cross-sectional view showing the wheel lock mechanism together with the peripheral construction under a state that the lock pin is hooked to the wheel lock mechanism.
Figure 16:
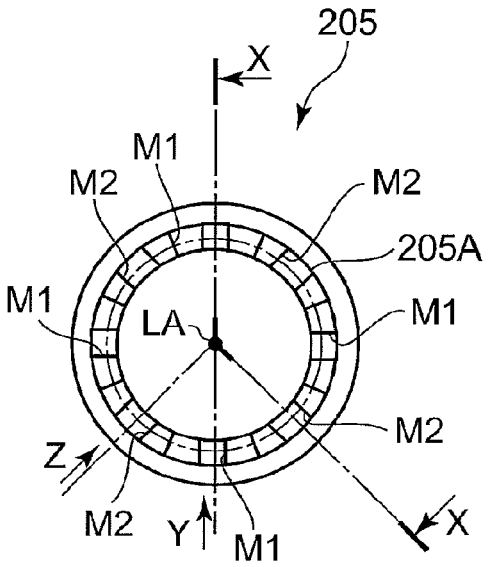
FIG. 16(A) is a left side view of a snap ring.
FIG. 16(B) is a cross-sectional view (X-X cross-sectional view of FIG. 16(A))
FIG. 16(C) is a view taken when
FIG. 16(D) is a view taken when
Figure 16:
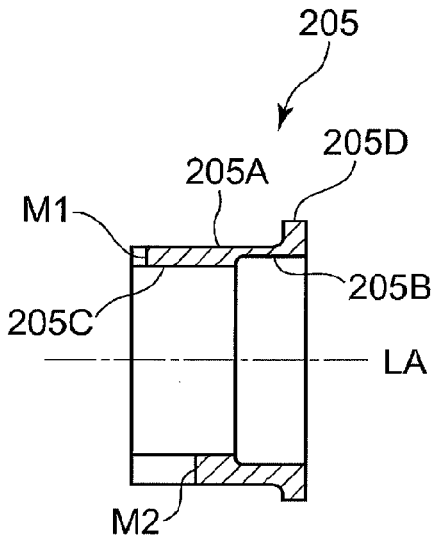
Figure 16:
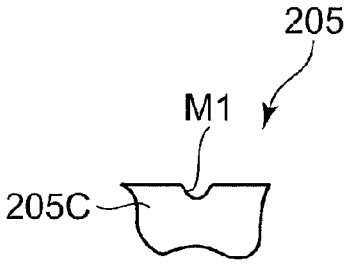
Figure 16:
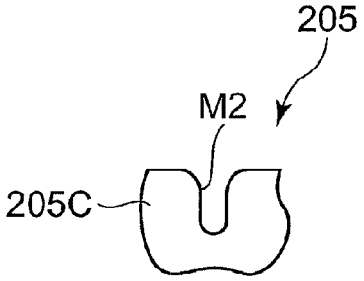

As shown in FIGS. 16(*c*) (D), these lock groove portions M1 and unlock groove portions M2 are grooves extending linearly from the open-side end face of the non-contact side cylinder portion 205C in the axle direction (to the disc portion 202 side). As shown in FIG. 13, the lock groove portion M1 is formed as a short groove for moving the snap ring 205 outwards in the vehicle width direction till the lock position at which the lock pin 204 passes through the hole portion 202A of the disc portion 202. As shown in FIG. 10, the unlock groove portion M2 is formed as a groove which is long in the axle direction and evacuates the snap ring 205 inwards in the vehicle width direction till the unlock position at which the lock pin 204 is evacuated from the disc portion 202.

In this construction, the lock groove portions M1 and the unlock groove portions M2 are alternately formed at angular intervals of 45°. Accordingly, every time the worker rotates the snap ring 205 by 45° with his/her hand or a tool, the snap ring 205 is switched between the positions corresponding to the lock position and the unlock position, respectively.

Subsequently, the process of fabricating the wheel lock mechanism 201 will be described. The wheel lock mechanism 201 is sub-assembled by securing respective members to the slide shaft 201A, and finally the axle 52 is inserted into the sub-assembled wheel lock mechanism 201 and fastened to the wheel lock mechanism 201 by a bolt 220, thereby assembling the wheel lock mechanism 201. It is assumed that the stopper pin 208 is secured to the slide shaft 201A in advance.

More specifically, the snap ring 205, the slider 203 and the return spring 206 are successively fitted to the slide shaft 201A, and the lock pin 204 and the lock pin spring 207 are secured to the slider 203 before or after the fitting of the slider 203. Thereafter, the bearing 59 and the hub portion 57 are secured to the slide shaft 201A, and the axle 52 is inserted into the slide shaft 201A, and fastened to the slide shaft 201A by the bolt 220.

As described above, the wheel lock mechanism 201 is sub-assembled, and then secured to the axle 52, so that the installation of the wheel lock mechanism 201 to the axle 52 is easily performed.

Next, the operation of the wheel lock mechanism 201 will be described with reference to FIGS. 10 to 13.

As shown in FIG. 10, when the unlock groove portion M2 of the snap ring 205 is located at the same phase position as the stopper pin 208, the slider 203 and the snap ring 205 are moved to the opposite side to the disc portion 202 (moved to the inside in the vehicle width direction) by the return spring 206 until the stopper pin 208 comes into contact with the bottom portion of the unlock groove portion M2, and the stopper pin 208 is kept hooked at the bottom portion of the unlock groove portion M2. In this case, as shown in FIG. 10, the lock pin 204 is moved to the unlock position at which the lock pin 204 is evacuated from the disc portion 202. Therefore, the axle 52 and the wheels 53 are set to an unlock state, so that the wheels 53 are kept under a free state under which the wheels 53 are freely rotated.

Figure 11:
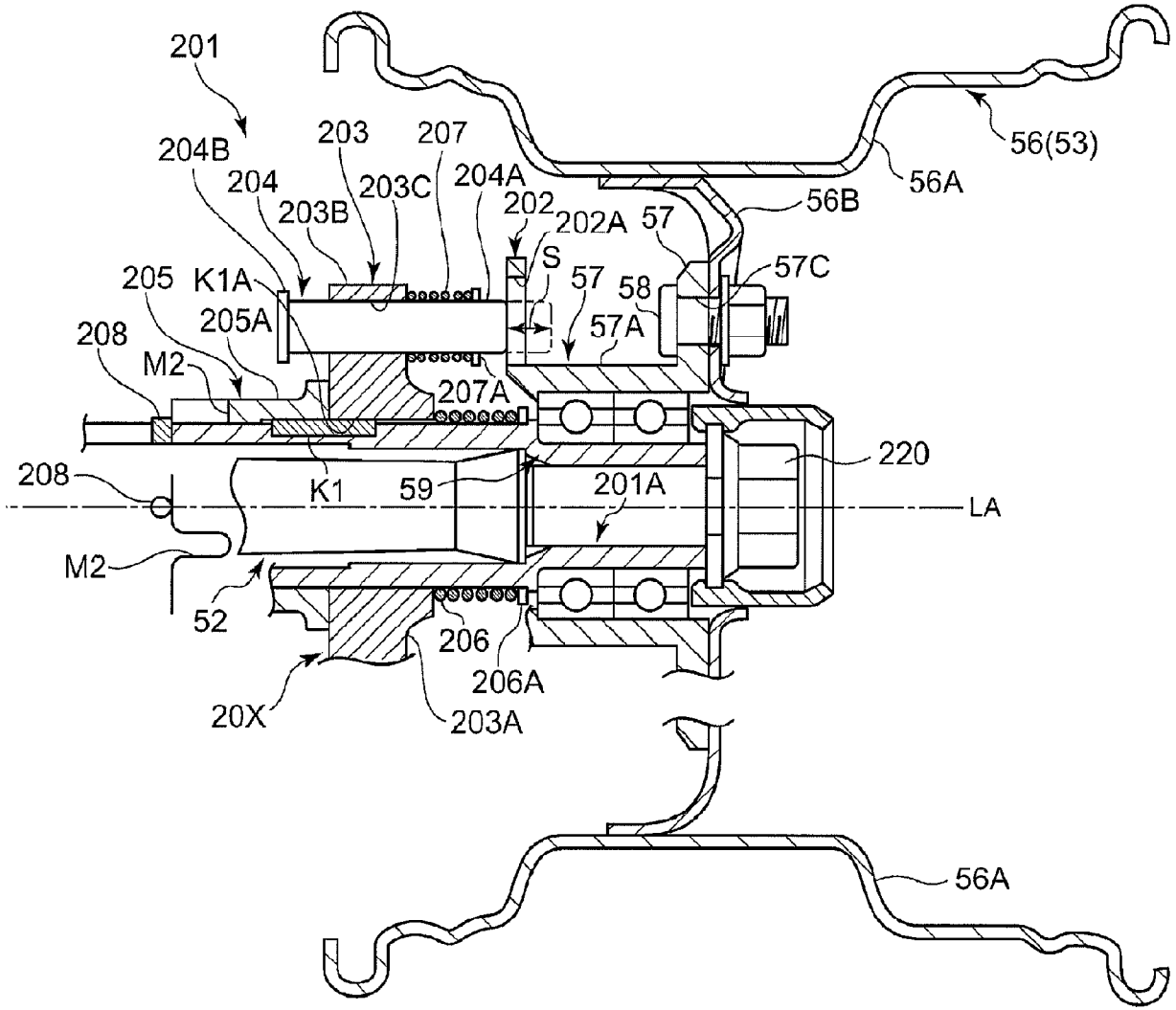
FIG. 11 is a side view showing the wheel lock mechanism under operation together with the peripheral construction thereof.

In order to rotate the snap ring 205, the snap ring 205 is slid to the disc portion 202 side against the urging force of the return spring 206 until the stopper pin 208 gets out of the unlock groove portion M2 as shown in FIG. 11.

Figure 12:
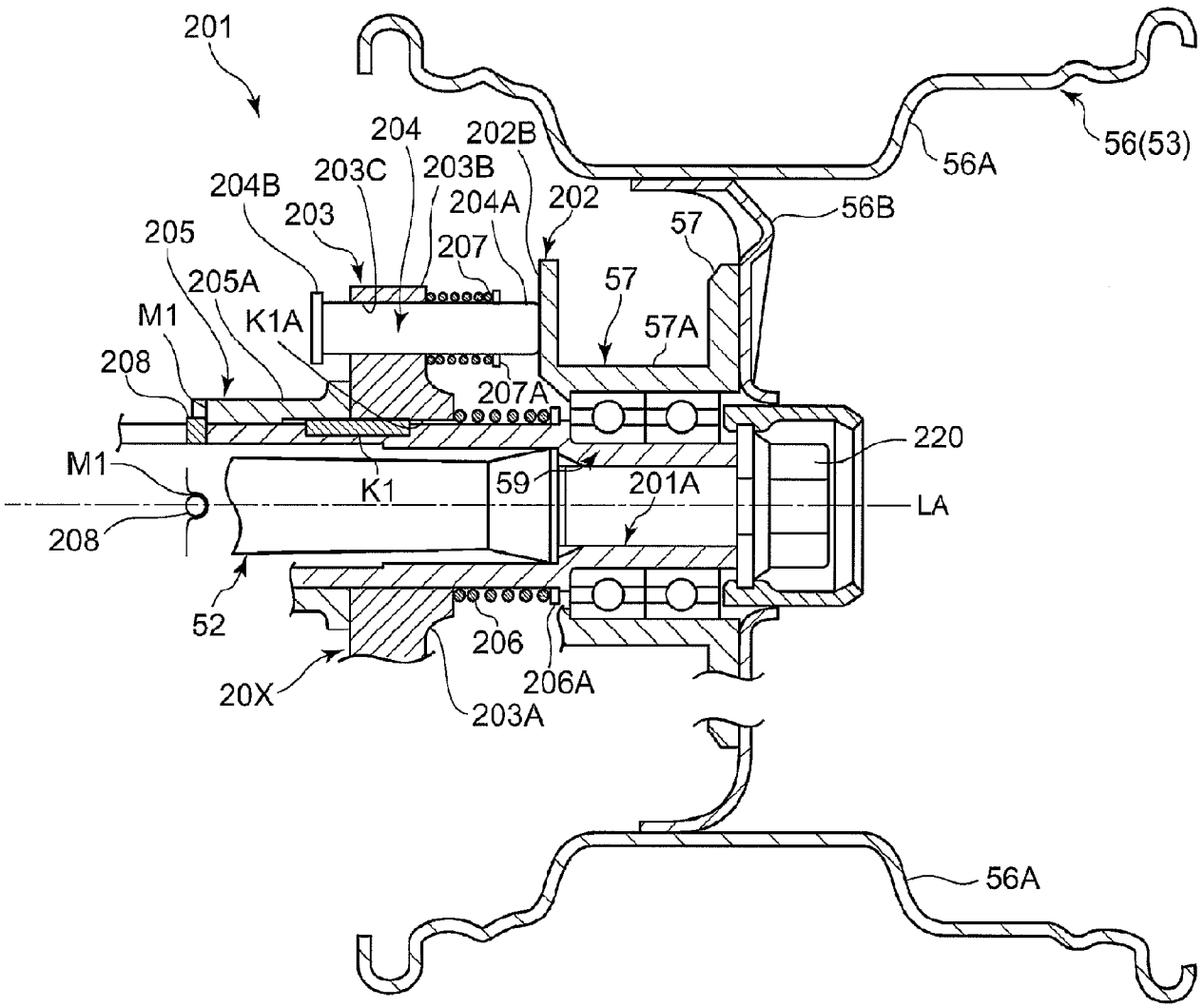
FIG. 12 is a side cross-sectional view showing the wheel lock mechanism together with the peripheral construction thereof under a state that a lock pin comes into contact with the wheel lock mechanism.

Subsequently, the snap ring 205 is rotated, and the sliding operation force imposed on the snap ring 205 is released at the position where the lock groove portion M1 of the snap ring 205 is located at the same phase position as the stopper pin 208, whereby the slider 203 and the snap ring 205 are pushed out to the opposite side to the disc portion 202 (pushed to the inside in the vehicle width direction) by the urging force of the return spring 206 until the stopper pin 208 comes into contact with the bottom of the lock groove portion M1 as shown in FIG. 12. Accordingly, the stopper pin 208 is kept to be hooked to the bottom portion of the lock groove portion M1.

In this case, the slider 203 moves to the lock position at which the hole portion 202A of the disc portion 202 is located within a movement stroke S (see FIG. 11) along the axial direction of the lock pin 204. However, the lock pin 204 and the hole portion 202A of the disc portion 202 are not necessarily matched with each other in phase even at the lock position. When they are not matched with each other in phase, the wheels 53 are rotated to keep the state that the lock pin 204 comes into contact with the non-penetration portion 202B as an area between the hole portions 202A of the disc portion 202 by the urging force of the lock pin spring 207 as shown in FIG. 12.

As described above, when the lock pin 204 and the hole portion 202A of the disc portion 202 are not matched with each other in phase, the lock pin 204 is kept to the state that the lock pin 204 is urged so as to come into contact with the non-penetration portion 1202B of the disc portion 202. Accordingly, when the lock pin 204 and the hole portion 202A of the disc portion 202 are matched with each other in phase, the urging force makes the lock pin 204 immediately enter the hole portion 202A of the disc portion 202, and the fitting state of the lock pin 204 and the hole portion 202A is kept (see FIG. 13). Accordingly, the axle 52 and the wheels 53 are set to the lock state, and the axle 52 and the wheels 53 are joined to each other to rotate integrally with each other.

Here, in the garbage separation and recovery machine 50, the axle 52 is rigidly joined to one of the wheels 53, and the bearing (ball bearing) 59 is interposed between the other wheel 53 and the axle 52 as shown in FIG. 10, thereby establishing a free hub structure.

This construction has an advantage that the handling performance when the garbage separation and recovery machine 50 is towed can be more remarkably enhanced as compared with a case where the right and left wheels 53 are rigidly assembled. However, when the carry amount of sand/garbage in the drum type sieving unit 54 is large, when wet sand/garbage is carried, and when the vehicle runs on a place at which friction of the sand is little or the like, the free hub structure makes it impossible to rotate the weighty drum type sieving unit 54 by only the wheel 53 at the rigid side, so that the wheel 53 concerned is not rotated, but dragged.

Therefore, in this garbage separation and recovery machine 50, when the carry amount of sand/garbage in the drum type sieving unit 54 is large, when wet sand/garbage is carried, and when the vehicle runs at a place where the friction of the sand or the like is little or the like, the right and left wheels are switched to the lock state as described above, and the weighty drum type sieving unit 54 can be rotated by the right and left wheels 53, so that the wheel 53 can be prevented from being dragged.

Furthermore, in the manual rotation mode, the force required to rotate the drum type sieving unit 54 can be reduced by releasing the lock state of the right and left wheels, and thus the drum type sieving unit 54 can be easily rotated.

In this construction, as shown in FIGS. 10 to 13, the wheel lock mechanism 201 has the disc portion 202 which rotates integrally with the wheel 53 inside the rim portion 56A of the wheel 53, and the slide member 20X (the slider 203 and the lock pin 204) which is movable in the axial direction of the axle 52 so as to be freely fitted to the disc portion 202 and rotatable integrally with the axle 52 inside the rim portion 56A. Therefore, the wheel lock mechanism 201 can be disposed compactly by using the inner space of the rim portion 56A. In addition, the wheel lock mechanism 201 can be prevented from being poured with sand dropping from the drum type sieving unit 54 or surrounding sand by the rim portion 56A and the tire mounted on the rim portion 56A.

Here, the garbage separation and recovery machine 50 is a towed type simple vehicle which has no driving source (engine) by itself and has no brake device in the wheel 53, and thus the dead space is necessarily formed in the rim portion 56A of the wheel 53. As described above, according to this construction, the wheel lock mechanism 201 is disposed in the dead space, it is not required to separately provide the installation space for the wheel lock mechanism 201, and the wheel lock mechanism 201 can be easily and compactly disposed by using an existing space.

In addition, in this construction, all the parts constituting the wheel lock mechanism 201 are formed to have outer diameters smaller than the inner diameter of the rim portion 56*a* of the wheel body 56, and disposed in the space surrounded by the rim portion 56A so as to be near to the wheel disc portion (bridging portion) 56B. Therefore, the whole wheel lock mechanism 201 can be efficiently and compactly disposed, and the effect of surrounding sand, etc. on these parts can be avoided.

Particularly, in this construction, as shown in FIGS. 10 to 13, the disc portion 202 and the lock pin 204 as the lock sites of the wheel lock mechanism 201 and the sprints 206, 207 actuating the respective parts are completely accommodated within the width of the rim portion 56A. Therefore, the disc portion 202 and the lock pin 204 are fitted to each other within the width of the rim portion 56A, the effect of sand, etc. on the fitting portion and the actuation portion can be effectively avoided, and the wheel lock mechanism 201 can be smoothly operated.

Furthermore, the wheel lock mechanism 201 is provided inside the wheel body 56 of the wheel 53 in the vehicle width direction. Therefore, it does not protrude to the outside in the vehicle width direction of the garbage separation and recovery machine 50, and can be disposed by using the empty space between the wheel 53 and the axle support frame 61D (see FIG. 2), whereby the garbage separation and recovery machine 50 can be avoided from being designed in large scale.

Furthermore, the disc portion 202 has the hole portions 202A penetrating in the axial direction of the axle 52 and the non-penetration portions 202B which does not penetrate, the slide member 20X has the lock pin 204 which moves in the axial direction so as to be capable of entering the hole portion 202A, and the lock pin spring (urging member for lock) 207 which urges the lock pin 204 to the disc portion 202, brings the lock pin 204 into contact with the non-penetration portion 202B until the lock pin 204 is matched with the hole portion 202A in phase, and makes the lock pin 204 enter the hole portion 202 when they are matched with each other in phase through the rotation of the wheel 53. Therefore, when the lock pin 204 and the hole portion 202A of the disc portion 202 are matched with each other in phase, the axle 52 and the wheel 53 are automatically locked to each other, and the switching to the lock state can be easily performed.

In this case, the lock pin 204 is freely movably held by the slider 203, and the slider 203 is moved to the lock position where the disc portion 202 is located within the movement stroke S (see FIG. 11) of the lock pin 204 to make the lock pin 204 enter the hole portion 202A, and also moved to the unlock position where the disc portion 202 is located out of the hole portion 202A, that is, out of the movement stroke S. Therefore, the lock/unlock can be easily switched to each other by moving the slider 203.

There are provided the return spring (urging member for return) 206 for urging the slider 203 to the unlock position and the snap ring 205 which is freely rotatably provided to the axle 52 and moves the slider 203 to the lock position against the urging force of the return spring 206 by the rotation thereof. Therefore, the slider 203 can be easily moved to the unlock position by the urging force of the return spring 206, and the switching to the unlock state can be easily performed. In this case, the wheel lock mechanism 201 can be actuated by a simple operation such as an worker's rotating operation of the snap ring 205.

Furthermore, as shown in FIG. 10, the snap ring 205 is exposed out of the width of the rim portion 56A of the wheel 53. Therefore, the snap ring 205 can be operated without being disturbed by the rim portion 56A, and the operability of the wheel lock mechanism 201 can be enhanced.

Furthermore, the lock pin spring 207 is a coil spring through which the lock pin 204 is inserted, and the return spring 206 is a coil spring through which the axle 52 is inserted. Therefore, the springs can be disposed by using the narrow space around the lock pin 204 and the axle 52 and laid out to be near to the axle 52, and the wheel lock mechanism 201 can be made compact in the radial direction.

Furthermore, the disc portion 202 is provided to the hub portion 57 of the wheel body 56, and the fastening member 58 constituting the fastening portion for fastening the hub portion 57 to the wheel body 56 and the hole portion 202A of the disc portion 202 are provided to be matched with each other in phase. Therefore, a work of inserting a tool from the hole portion 202A of the disc portion 202 to fasten the hub portion 57 to the wheel body 56 can be easily performed.

The garbage separation and recovery machine 50 according to this embodiment has the drum type sieving body 54 which is designed like a cylindrical basket having a bottom and freely rotatably secured to the vehicle body frame towed by the vehicle 1, the driving gear 92 which is freely rotatably supported by the vehicle body frame 51 and secured to the axle 52 to which the right and left wheels 53 are secured, and the mechanism portion (transmission mechanism) 91 for transmitting the driving force of the driving gear 92 to the drum type sieving unit 54. The mechanism portion 91 is freely slidably provided to the clutch pipe which is provided to the vehicle body frame 51 in parallel to the axle 52, and has the driven gear 93 engaged with/disengaged from the driving gear 92, the engagement pieces 94 which are provided on the outer periphery of the drum type sieving unit 54 and engaged with the driven gear 93 at the position where the driven gear 93 is engaged with the driving gear 92, and the gear switching mechanism (switching means) 95 for sliding the driven gear 93 to the position where the driven gear 93 is engaged with the driving gear 92 and evacuating the driven gear 93 from the position where the driven gear 93 is engaged with the driving gear 92.

According to this construction, by sliding the driving gear 93 to the engagement position with the driving gear 92 through the gear switching mechanism 95, the mode can be switched to the automatic rotation mode in which the drum type sieving unit 54 is rotated by the rotational force of the wheels 53. Furthermore, by evacuating the driven gear 93 from the engagement position with the driving gear 92 through the gear switching mechanism 95, the mode can be switched to the manual rotation mode in which the drum type sieving unit 54 is rotated manually.

Accordingly, at a ground-leveled place, the garbage separation work can be performed by rotating the drum type sieving body 54 with the towing force of the vehicle 1. At an irregular ground place where the towing work of the vehicle 1 is impossible, the garbage separation work can be performed by easily manually rotating the drum type sieving unit 54 with human power. The drum type sieving unit 54 is rotated by the towing force while it is towed by the vehicle 1. When the vehicle is stopped, the drum type sieving unit 54 is manually rotated to continue the garbage separation work based on the drum type sieving unit 54. When the drum type sieving unit 54 is vacant, the manual rotation mode is kept, whereby the drum type sieving unit 54 can be avoided from unnecessarily rotating during towing. As described above, the garbage separation work can be performed in accordance with various conditions.

In addition, the mechanism portion 91 for rotating the drum type sieving unit 54 has the driving gear 92 provided to the axle 52, the driven gear 93 which is freely slidably provided to the clutch pipe 96 provided in parallel to the axle 52, and the engagement pieces 94 provided on the outer periphery of the drum type sieving unit 54. Therefore, the mechanism portion 91 can be designed in a simple engagement structure, and thus the mechanism portion 91 can be miniaturized, so that the garbage separation machine 50 can be miniaturized. Accordingly, there can be provided the garbage separation and recovery machine 50 which has a simple structure and enhanced mobility and can gather and separate garbage while moving on a seacoast as an irregular ground and perform the garbage separation work in accordance with the condition by mode switching.

In this construction, the engagement pieces 94 protrude outwards in the radial direction from the outer periphery of the sieving unit 54 so as to be spaced from one another in the peripheral direction of the drum type sieving unit 54, the driving gear 92 has the plural rod-like members 92B extending from the outer periphery of the gear 92 in the axial direction of the axle 52 so as to be spaced from one another in the peripheral direction of the gear 92, and the driven gear 93 is engaged with the rod-like members 94B as the projecting tips of the engagement pieces 94 and the rod-like members 92B of the driving gear 92. Therefore, the driven gear 93 and each of the rod-like members 94B, 92B can be easily engaged with each other, the engagement/disengagement can be smoothly switched to each other, the engagement state can be kept during running on an irregular ground such as seacoast or the like, sand easily drops from the rod-like members 94B, 92B and sand is difficult to stay at the engagement portion, so that the friction can be suppressed.

Furthermore, the drum type sieving unit 54 is disposed at the upper side of the axle 52 so that the rotation center (axial line LA) of the drum type sieving unit 54 is displaced from the axle 52 in the front-and-rear direction, and the rotation center (axial line LB) of the driven gear 93 is provided between the rotation center (axial line LA) of the drum type sieving unit 54 and the axle 52 in side view. Therefore, the driven gear 93 can be disposed by using the vacant space between the drum type sieving unit 54 and the axle 52. Accordingly, the mechanism portion 91 can be miniaturized, and the garbage separation and recovery machine 50 can be miniaturized in the up-and-down direction.

Furthermore, the gear switching mechanism 95 is supported by the vehicle body frame 51 so as to be freely turnable in the axle direction with the middle portion 102 as a fulcrum, the driven gear 93 is joined to the tip portion 101 thereof, and the gear switching mechanism 95 is provided with the operation lever 100 for sliding the driven gear 93 through the turning thereof in the axle direction. Therefore, the driven gear 93 can be moved to switch the mode with a simple structure using a simple operation lever 100.

Furthermore, in this construction, the vehicle body frame 51 has the main frame 61 which has the joint 55 secured to the trailer hitch 11 at the front end thereof, extends from the joint 55, passes through the width center C1 of the garbage separation and recovery machine 50, linearly extends rearwards and then rearwards and downwards and supports the axle 52 at the rear end thereof, the sieving body support frame 62 which is supported above the main frame 61 to support the drum type sieving unit 54 so that the drum type sieving unit 54 is freely rotatable through the guide rollers 71, and the shield body 63 which is supported by the sieving unit support frame 62 and covers the periphery of the drum type sieving unit 54. Therefore, the main frame 61 can be miniaturized in the vehicle width direction and in the up-and-down direction, the drum type sieving unit 54 can be supported through the sieving unit support frame 62 at a workability-excellent place above the main frame 61, and the drum type sieving unit 54 can be covered by the shield unit 63. Accordingly, the garbage separation and recovery machine 50 can be constructed by the compact frame structure.

Furthermore, in this construction, the main frame 61 has the front portion 61A linearly extending rearwards from the joint 55, and the rear portion 61B which extends rearwards and downwards from the rear end of the front portion 61A and supports the axle 52 at the rear end thereof. The front portion 61A is formed to be longer than the rear portion 61B, and the driven gear 93 is disposed to be overlapped with the wheels 53 between the rear portion 61B and the drum type sieving body 54 in side view. Therefore, the driven gear 93 can be disposed compactly by using the space between the main frame 61 and the drum type sieving body 54, and the driven gear 93 can be guarded by the rear portion 61B of the main frame 61 and the wheels 53. Furthermore, the height of the joint 55 with respect to the axle 52 can be secured, and thus the attitude of the garbage separation and recovery machine 50 can be suppressed from varying due to the height difference from the trailer hitch 11 of the vowing vehicle 1.

Furthermore, in this construction, the sieving body support frame 62 has the support frame 65 for supporting the sieving unit support frame 62 at the upper side of the main frame 61, and the support frame 65 has the front support frame 66 which extends upwards from the front portion 61A of the main frame 61 and supports the sieving unit support frame 62. Therefore, the sieving unit support frame 62 can be supported at a position near to the main frame 61, and the support rigidity of the drum type sieving unit 54 can be secured.

Furthermore, the support frame 65 has the rear support frame 67 which extends upwards from the rear end of the main frame 61 and supports the sieving unit support frame 62, and the driven gear 93 is disposed behind the front support frame 66 and in front of the rear support frame 67. Therefore, the front and rear sides of the driven gear 93 can be guarded by the support frames 66 and 67.

The embodiment described above is an example of the present invention, and any modification and application may be made without departing from the subject matter of the present invention.

For example, in the above embodiment, the rotation center (axial line LA) of the drum type sieving unit 54 is disposed to be displaced frontwards from the axle 52 and the rotation center (LC) of the driven gear 93 is disposed between the rotation center (axial line LA) of the drum type sieving unit 54 and the axle 52. However, the present invention is not limited to this style. The rotation center (axial line LA) of the drum type sieving unit 54 may be disposed to be displaced rearwards from the axle 5, and the rotation center (LC) of the driven gear 93 may be provided between the rotation center (axial line LA) of the drum type sieving unit 54 and the axle 52. In this case, the garbage separation and recovery machine 50 can be more miniaturized in the up-and-down direction as compared with the case where the drum type sieving unit 54, the driven gear 93 and the axle 52 are arranged vertically in the up-and-down direction.

Furthermore, in this embodiment, the garbage separation and recovery machine 50 is formed of metal members such as metal pipes, etc. However, the present invention is not limited to this style, and the garbage separation and recovery machine 50 may be formed of other rigid materials other than the metal members, for example, resin materials or the like.

Still furthermore, in the above embodiment, the present invention is applied to the garbage separation and recovery machine 50 for beach cleaning shown in FIG. 1, etc. However, the present invention is not limited to this style. For example, in the above embodiment, there is used the separation mechanism for separating sand garbage from each other by using the rotating type drum type sieving unit 54. However, there may be used another separation mechanism for separating sand and garbage from each other by using the rotation force of the axle 52, for example by using a swing type sieving unit. It is needless to say that the garbage separation and recovery machine 50 may be used at a place other than the beach. Furthermore, the present invention may be applied to a work vehicle such as a special working compact vehicle (containing a garbage separation and recovery machine) which is smaller than a special work vehicle such as a tractor or the like and has a dead space inside the rim portion of the wheel.

DESCRIPTION OF REFERENCE NUMERALS

1 vehicle
20X slide member
50 garbage separation and recovery machine (work vehicle) for beach cleaning
51 vehicle body frame
52 axle
53 wheel
54 drum type sieving unit (rotating member, separation mechanism)
56 wheel body
56A rim portion
56B wheel disc portion (bridging portion)
57 hub portion
57C hole portion
58 fastening member (fastening portion)
91 mechanism portion (transmission mechanism)
92 driving gear
93 driven gear
94 fitting pieces
95 gear switching mechanism (switching means)
96 clutch pipe
201 wheel lock mechanism
201A slide shaft
202 disc portion (disc member)
203 slider (slide member)
204 lock pin (slid member)
205 snap ring
206 return spring (urging member for return)
207 lock pin spring (urging member for lock)
LA axial line of drum type sieving unit (rotation center)

The invention claimed is:

1. A work vehicle having a vehicle body frame (51) towed by a vehicle with right and left wheels (53) secured to an axle (52), said right and left wheels being freely rotatably supported by the vehicle body frame (51), and a rotating unit (54) which is rotated by a rotational force of the axle (52), and further comprising:

a wheel lock mechanism (201) that locks and unlocks at least one of the wheels (53) to and from the axle (52), wherein the wheel lock mechanism (201) has a disc member (202) that rotates integrally with the at least one of the wheels (53) inside a rim portion (56A) of the at least one of the wheels (53), and a slide member (20X) that is movable in an axial direction of the axle (52) so as to be engageable with the disc member (202) inside the rim portion (56A) and rotates integrally with the axle (52).

2. The work vehicle according to claim 1, wherein the disc member (202) has a hole portion (202A) penetrating through the disc member (202) in the axial direction of the axle (52) and a non-penetration portion (202B) that non-penetrates therethrough, the slide member (20X) has a lock pin (204) that moves in the axial direction so as to be capable of entering the hole portion (202A), and there is provided an urging member (207) that urges the lock pin (204) to the disc member (202) so that the lock pin is brought into contact with the non-penetration portion (202B) until the lock pin (204) and the hole portion (202A) are matched with each other in phase, and makes the lock pin enter the hole portion (202A) when the lock pin (204) and the hole portion (202A) are matched with each other in phase through the rotation of the at least one of the wheels (53).

3. The work vehicle according to claim 2, wherein the slide member (20X) has a slider (203) that supports the lock pin (204) so that the lock pin (204) is freely movable in the axial direction of the axle (52), and the slider (203) is movable to a lock position at which the lock pin (204) is made to enter the hole portion (202A) and an unlock position at which the lock pin (204) is located out of the hole portion (202A).

4. The work vehicle according to claim 3, further comprising: an urging member for return (206) that urges the slider (203) to the unlock position; and a snap ring (205) that is freely rotatably provided to the axle (52) and moves the slider (203) to the lock position against urging force of the urging member for return (206) by rotation thereof.

5. The work vehicle according to claim 4, wherein the disc member (202) and the lock pin (204) are engaged with each other within a width of the rim portion (56A), and the snap ring (205) is exposed to an outside of the width of the rim portion (56A).

6. The work vehicle according to claim 2, wherein the urging member (207) comprises a first coil spring through which the lock pin (204) is inserted, and the urging member for return (206) comprises a second coil spring through which the axle (52) is inserted.

7. The work vehicle according to claim 1, wherein the disc member (202) is provided to a hub portion (57) of the at least one of the wheels (53), a fastening portion (58) that fastens the hub portion (57) to a wheel body (56) of the at least one of the wheels (53) is provided, and the fastening portion (58) and the hole portion (202A) of the disc member (202) are provided to be in phase with each other.

8. The work vehicle according to claim 1, wherein the rotating unit (54) is a drum type sieving unit that is freely rotatably secured to the vehicle body frame (51) above the axle (52), and the work vehicle is a garbage separation and recovery machine that has a driving gear (92) secured to the axle (52), and a transmission mechanism (91) that transmits driving force of the driving gear (92) to the drum type sieving unit (54).

9. The work vehicle according to claim 8, wherein the transmission mechanism (91) has switching means (95) that switches an automatic rotation mode in which the drum type sieving unit (54) is rotated by rotational force of the axle (52) and a manual rotation mode in which the drum type sieving unit (54) is released from the rotational force of the axle (52) and made to be manually freely rotatable.

10. The work vehicle according to claim 3, wherein the urging member (207) comprises a coil spring through which the lock pin (204) is inserted, and the urging member for return (206) comprises a coil spring through which the axle (52) is inserted.

11. The work vehicle according to claim 4, wherein the urging member (207) comprises a coil spring through which the lock pin (204) is inserted, and the urging member for return (206) comprises a coil spring through which the axle (52) is inserted.

12. The work vehicle according to claim 5, wherein the urging member (207) comprises a coil spring through which the lock pin (204) is inserted, and the urging member for return (206) comprises a coil spring through which the axle (52) is inserted.

13. The work vehicle according to claim 2, wherein the disc member (202) is provided to a hub portion (57) of the at least one of the wheels (53), a fastening portion (58) that fastens the hub portion (57) to a wheel body (56) of the at least one of the wheels (53) is provided, and the fastening portion (58) and the hole portion (202A) of the disc member (202) are provided to be in phase with each other.

14. The work vehicle according to claim 3, wherein the disc member (202) is provided to a hub portion (57) of the at least one of the wheels (53), a fastening portion (58) that fastens the hub portion (57) to a wheel body (56) of the at least one of the wheels (53) is provided, and the fastening portion (58) and the hole portion (202A) of the disc member (202) are provided to be in phase with each other.

15. The work vehicle according to claim 4, wherein the disc member (202) is provided to a hub portion (57) of the at least one of the wheels (53), a fastening portion (58) that fastens the hub portion (57) to a wheel body (56) of the at least one of the wheels (53) is provided, and the fastening portion (58) and the hole portion (202A) of the disc member (202) are provided to be in phase with each other.

16. The work vehicle according to claim 5, wherein the disc member (202) is provided to a hub portion (57) of the at least one of the wheels (53), a fastening portion (58) that fastens the hub portion (57) to a wheel body (56) of the at least one of the wheels (53) is provided, and the fastening portion (58) and the hole portion (202A) of the disc member (202) are provided to be in phase with each other.

17. The work vehicle according to claim 6, wherein the disc member (202) is provided to a hub portion (57) of the at least one of the wheels (53), a fastening portion (58) that fastens the hub portion (57) to a wheel body (56) of the at least one of the wheels (53) is provided, and the fastening portion (58) and the hole portion (202A) of the disc member (202) are provided to be in phase with each other.

18. The work vehicle according to claim 2, wherein the rotating unit (54) is a drum type sieving unit that is freely rotatably secured to the vehicle body frame (51) above the axle (52), and the work vehicle is a garbage separation and recovery machine that has a driving gear (92) secured to the axle (52), and a transmission mechanism (91) that transmits driving force of the driving gear (92) to the drum type sieving unit (54).

19. The work vehicle according to claim 3, wherein the rotating unit (54) is a drum type sieving unit that is freely rotatably secured to the vehicle body frame (51) above the axle (52), and the work vehicle is a garbage separation and recovery machine that has a driving gear (92) secured to the axle (52), and a transmission mechanism (91) that transmits driving force of the driving gear (92) to the drum type sieving unit (54).

20. The work vehicle according to claim 4, wherein the rotating unit (54) is a drum type sieving unit that is freely rotatably secured to the vehicle body frame (51) above the axle (52), and the work vehicle is a garbage separation and recovery machine that has a driving gear (92) secured to the axle (52), and a transmission mechanism (91) that transmits driving force of the driving gear (92) to the drum type sieving unit (54).

* * * * *